US007044044B2

(12) United States Patent
Rodriguez et al.

(10) Patent No.: US 7,044,044 B2
(45) Date of Patent: May 16, 2006

(54) RADIO FREQUENCY TRIGGERED DIRECTED ENERGY MUNITION

(75) Inventors: Raul D. Rodriguez, Alexandria, VA (US); Anthony L. Bartos, Springfield, VA (US); Richard G. Robertson, Fairfax Station, VA (US)

(73) Assignee: Computer Science Corporation, El Segundo, CA (US)

( * ) Notice: Subject to any disclaimer, the term of this patent is extended or adjusted under 35 U.S.C. 154(b) by 144 days.

(21) Appl. No.: 10/688,853

(22) Filed: Oct. 17, 2003

(65) Prior Publication Data

US 2005/0115385 A1 Jun. 2, 2005

(51) Int. Cl.
*F41B 15/00* (2006.01)

(52) U.S. Cl. ..... 89/1.11
(58) Field of Classification Search ..... 89/1.11; 42/114, 115, 116
See application file for complete search history.

(56) References Cited

U.S. PATENT DOCUMENTS

| | | | | | |
|---|---|---|---|---|---|
| 3,427,611 | A | * | 2/1969 | Enenstein | 342/54 |
| 3,946,233 | A | * | 3/1976 | Erben et al. | 250/347 |
| 4,622,554 | A | * | 11/1986 | Gellekink et al. | 342/67 |
| 5,198,607 | A | * | 3/1993 | Livingston et al. | 89/1.11 |
| 6,061,170 | A | * | 5/2000 | Rice et al. | 359/345 |
| 6,215,731 | B1 | * | 4/2001 | Smith | 367/128 |
| 6,396,577 | B1 | * | 5/2002 | Ramstack | 356/141.1 |
| 6,621,764 | B1 | * | 9/2003 | Smith | 367/128 |
| 6,785,315 | B1 | * | 8/2004 | Hook et al. | 372/55 |

FOREIGN PATENT DOCUMENTS

DE 3804445 A1 * 8/1989

OTHER PUBLICATIONS

"World's First Ray Gun Shoots Down Missile", http://www.spacedaily.com Jun. 7, 2000 (4 pages).

"Laser gun zaps missile", BBC New Online: Sci/Tech; www.bbc.co.uk; Jun. 8, 2000 (3 pages).

"Thel Shoots Down Two More Katyushas in Latest Test"; Jinsa Online, www.jinsa.org; Sep. 22, 2000 (2 pages).

Possel, William H., Lt Col; "Laser and Missile Defense: New concepts for Space–Based and Ground–Based Laser Weapons", FAS Military Analysis Network; www.fas.org; Jul. 1998 (43 pages).

"AN/SLQ–32 Electronic Warfare (EW) System"; Fas Military Analysis Network; www.fas.org; Date Unknown (last page indicates "Updated Wednesday, Jun. 30, 1999") (13 pages).

"AEGIS Weapon System MK–7", FAS Military Analysis Network; www.fas.org; Date Unknown (last page indicates "Updated Thursday, Dec. 31, 1998") (6 pages).

(Continued)

*Primary Examiner*—Michael J. Carone
*Assistant Examiner*—Troy Chambers
(74) *Attorney, Agent, or Firm*—Meyertons, Hood, Kivlin, Kowert & Goetzel, P.C.; Eric B. Meyertons

(57) ABSTRACT

A laser weapon cartridge for disabling and/or destroying a target is disclosed. In an embodiment, the laser weapon cartridge may be compatible within a ballistic gun. For example, the laser weapon cartridge may be placed in the breech of a gun and armed by the gun's firing device. The laser weapon cartridge may assess precise alignment of the optical axis of the laser with a target. Precise alignment maybe based on RF energy from the target. RF energy may be detected by an antenna array coupled to the laser weapon cartridge. When alignment of the target with the laser is detected, the laser weapon cartridge may fire a beam of laser light toward the target. In an embodiment, the laser light may be generated by a chemical laser.

46 Claims, 18 Drawing Sheets

OTHER PUBLICATIONS

"MK 34 Gun Weapon System (GWS)"; FAS Military Analysis Network; www.fas.org; Date Unknown (last page indicates "Updated Friday, Nov. 26, 1999") (2 pages).

"MK 45 5–inch/54–caliber (lightweight) gun, MK 45 5–inch/62–caliber (MOD 4 ERGM)gun"; FAS Military Analysis Network; www.fas.org; Date Unknown (last page indicates "Updated Friday, Nov. 26, 1999") (6 pages).

"AN/SPG–62 Fire Control Radar", FAS Military Analysis Network; www.fas.org; Date Unknown (last page indicates "Updated Saturday, Dec. 12, 1998") (one page).

"MK–99 Fire Control System (FCS)"; FAS Military Analysis Network; www.fas.org.; Date Unknown (last page indicates "Updated Saturday, Dec. 12, 1998") (one page).

White, Stanley A.; Intermediate–frequency Amplifer; www.accessscience.com; Date Unknown (last page indicates "Last Modified: Jun. 23, 2000") (one page).

Photonics Dictionary: Boresight; www.photonics.com/dictionary; date unknown (one page).

* cited by examiner

RADIO FREQUENCY TRIGGERED DIRECTED ENERGY MUNITION

BACKGROUND OF THE INVENTION

1. Field of Invention

Embodiments disclosed herein generally relate to directed-energy weapon systems. More specifically, embodiments relate to aiming directed-energy weapons systems.

2. Description of Related Art

In modern warfare, low-flying, fast moving and/or maneuvering weapons (e.g., missiles and/or artillery shells) may present a serious threat to military forces. The success of ballistic anti-missile systems in destroying an inbound threat may vary depending on the nature of the threat. For example, ship-based self-defense systems (e.g., the Aegis Weapon System (AWS) and the Evolved Sea Sparrow Missile (ESSM)), may be challenged by existing sea-skimming, maneuvering anti-ship missile (ASM) threats. One of the challenges ballistic anti-missile systems face is time of flight. The time of flight challenge results from the fact that a projectile directed toward an incoming threat experiences a non-negligible delay from the time the projectile is fired until the distance to the expected target location is covered. This time of flight delay may make hitting a fast moving and/or maneuvering target particularly difficult.

A potential solution to the time of flight issue is to minimize the time of flight to a substantially negligible value. For example, an energy-based weapon, such as a laser or particle beam, may significantly reduce the time of flight since the weapon's energy is directed toward the target at or near the speed of light. For example, in testing the Tactical High-Energy Laser (THEL) system proved to be potentially effective against both artillery shells and self-propelled missiles. However, in its tested configuration the THEL system is very large. For example, besides the laser itself, the THEL system includes a fire control radar component, a command center, a pointer-tracker component, and a fuel supply component. In all, the THEL system requires several semi-trailer sized shipping containers to transport it. Deploying such a large system may be a significant burden for a land-based force.

Issues associated with adding a new laser weapon cartridge to a modern warship may be that the size, weight and/or optical horizon access, required by the mechanical structure necessary for properly pointing and triggering the laser, may bring with it an adverse topside impact. For example, adding laser hardware to a deck or other upper surface of a ship may require the moving and/or modifying of a significant number of other systems. The cost of such modifications may inhibit such laser systems from being seriously considered for fleet-wide deployment.

SUMMARY

Embodiments disclosed herein generally relate to directed energy and laser weapon systems and methods of use. More specifically, embodiments relate to directed energy weapons systems (e.g., lasers and high energy microwaves) that are operatively compatible with existing weapons systems (e.g., ballistic weapons systems). As used herein, "laser" may refer to lasers and/or other directed energy weapons such as, but not limited to, optical lasers and high energy microwaves.

In an embodiment, a laser weapon cartridge may include a body configured to fit within a barrel of a gun. A laser may be included within the body. In such an embodiment, the laser may be configured to project a beam of laser light along the axis of the barrel upon firing.

In certain embodiments, a laser of a laser weapon cartridge may include a high energy laser. For example, the laser may include a chemical oxygen-iodine laser, a hydrogen-fluorine laser or a deuterium-fluorine laser. The laser may be configured to project a beam of laser light that may initiate and/or promote degradation (e.g., spalling) resulting in catastrophic material failure or other damage. In an embodiment, the laser may be a chemical laser and the laser weapon cartridge may include sufficient chemical reactants to fire the laser at least one time.

In some embodiments, a laser weapon cartridge may also include at least one antenna element or other sensor. For example, at least one antenna element or other sensor may be configured to detect signals while positioned within the barrel of the gun. Data gathered by at least one antenna element or other sensor may be usable to assess the relative position of a target. In various embodiments, an array of antenna elements may be used to detect signals to assess the relative position of a target.

In an embodiment, a laser weapon cartridge may further include at least one processor. In some embodiments, at least one processor may be included within the body of the laser weapon cartridge and be coupled to at least one antenna element or other sensor. In certain embodiments, signals received by at least one antenna element may be usable by at least one processor to assess relative direction of a target. In such embodiments, at least one processor may receive data from at least one antenna element or other sensor, and utilize the received information to assess a position of a target. In an embodiment, at least one processor may be configured to initiate firing of the laser weapon cartridge when certain criteria are met. For example, the processor may fire the laser weapon cartridge when a position of the target is assessed to substantially coincide with an optical axis of the laser. In another example, at least one processor may be configured to estimate a future position of the target and to fire the laser weapon cartridge when the estimated future position of the target is substantially aligned with the optical axis of the laser. At least one processor may be configured to estimate at least one target location where the laser has a relatively high probability of damaging the target.

In certain embodiments, at least one processor may be field programmable. For example, the programmable processor may be configured to receive program instructions that configure the programmable processor to initiate firing of the laser based on programmed conditions. In some embodiments, an arming mechanism may initiate at least one processor to begin looking for an opportunity to fire the laser weapon cartridge. For example, the laser weapon cartridge may be armed by the firing mechanism of the gun. In an embodiment, once the laser weapon cartridge is armed, the processor may fire the laser automatically if assessed criteria are met.

In an embodiment, a laser weapon cartridge may be used in conjunction with a system including a hollow elongated member and an aiming system. The aiming system may be configured to point the hollow elongated member in a desired direction. For example, in certain embodiments, a laser weapon cartridge may be used in conjunction with an existing weapons system. For example, the laser weapon cartridge may be disposed within a gun barrel of a ballistic gun. The existing weapons system may include a gun pointing system. In some embodiments, the gun pointing system may be configured to point the gun in a desired direction (e.g., optically toward a target, rather than pointing in the direction required for ballistic munitions). In certain embodiments, the gun pointing system may be further configured to track the target over a period of time. For example, a radar system of the weapons system may track the target and provide position information to the gun pointing system. In such embodiments, a sensor of the laser weapon cartridge may be configured to detect radar signals reflected by (or emitted by) the target.

In an embodiment, a weapons system including a laser weapon cartridge disposed within a gun may include a gun loading and/or unloading system (e.g., a spent shell ejection system). In such embodiments, the laser weapon cartridge may be configured to be loaded by the gun loading system. In such embodiments, the laser weapon cartridge may be configured to be unloaded (e.g., after firing) using the spent shell ejection system. In various embodiments, the gun utilizing the laser weapon cartridge may include rifling or may be substantially smooth.

In an embodiment, a method may include providing at least one antenna element disposed near and through the breech of a gun barrel. At least one antenna element may be configured to detect at least one signal. A processor may be provided in communication with at least one antenna element. The processor may be configured to assess a position of a target based at least in part on a signal detected by at least one antenna. In various embodiments, a signal detected by at least one antenna may include a signal transmitted toward the target, a signal reflected by the target and/or a signal transmitted by the target. In an embodiment, a plurality of antenna elements may be used. In such an embodiment, the processor may assess one or more difference signals among signals detected by the plurality of antenna elements to assess the position of the target.

A method may further include aiming the gun barrel toward the target (e.g., such that at least one antenna element has a substantially direct line of sight to the target).

In an embodiment, a method of firing a weapon at a target may include providing a weapon configured to fire along a firing path. At least one sensor configured to gather data corresponding to a position of a target relative to the firing path of the weapon may be provided. The weapon may be aimed toward the target. The position of the target relative to the firing path is monitored based on data gathered by at least one sensor. The weapon may be fired when the relative position of the target is assessed to substantially coincide with the firing path of the weapon. In an embodiment, the weapon may include a laser weapon cartridge as previously described.

In an embodiment, providing at least one sensor may include substantially surrounding the firing path with at least one sensor. In an embodiment, at least one sensor may be configured to gather data in a pattern substantially surrounding the firing path. In an embodiment, at least two sensors may be provided. In such embodiments, at least two sensors may be positioned substantially symmetrically around the firing path.

In an embodiment, after firing a weapon (e.g., a laser weapon cartridge) at a target a method may include determining whether the target was damaged by the weapon. In certain embodiments, subsequent to firing a laser weapon cartridge, the laser weapon cartridge may be ejected from the gun and another laser weapon cartridge may be loaded into the gun. The next laser weapon cartridge may be armed. In an embodiment, arming the laser weapon cartridge may configure the laser weapon cartridge to automatically fire at the target.

In an embodiment, a method of firing a weapon may include providing a weapons system comprising at least one weapon and at least one sensor. In some embodiments, at least one opportune position of a target relative to at least one weapon may be assessed using information from at least one sensor. At least one opportune position may include at least one position where at least one weapon has a relatively high probability of damaging the target. In some embodiments, at least one weapon may be fired at the target, if firing the weapon at the target will not inhibit firing at the target again when the target is at an opportune position.

BRIEF DESCRIPTION OF THE DRAWINGS

Advantages of the present invention will become apparent to those skilled in the art with the benefit of the following detailed description of the embodiment and upon reference to the accompanying drawings, in which.

Figure 1:
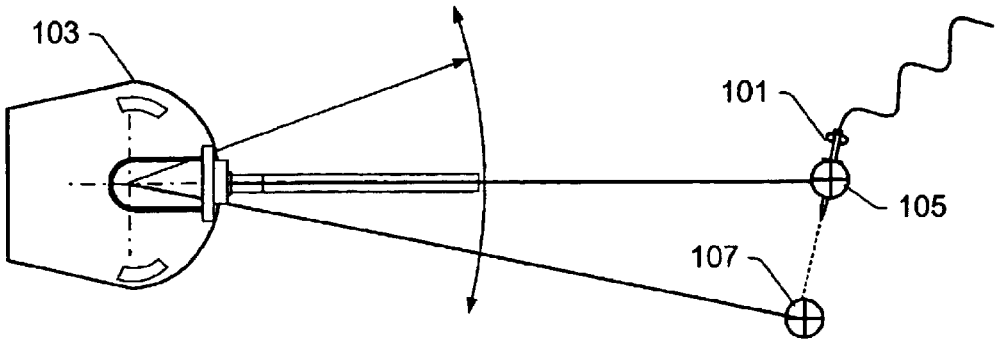
FIG. 1 shows a gun engaging a target, according to an embodiment.

While the invention is susceptible to various modifications and alternative forms, specific embodiments thereof are shown by way of example in the drawings and will herein be described in detail. It should be understood that the drawing and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF EMBODIMENTS

Embodiments disclosed herein generally relate to laser weapon cartridge systems. Certain embodiments relate to laser weapon cartridge systems that are operatively compatible with existing weapons systems. For example, embodiments may be related to laser weapon cartridge systems compatible with existing ballistic weapons systems. As used herein, a "ballistic weapons system" generally refers to a weapons system capable of firing a projectile or missile. As used herein, "projectile" and "missile" are used interchangeably to refer to an object that is either externally propelled (e.g., a bullet or artillery shell) or self-propelled (e.g., a rocket).

FIG. 1 depicts an embodiment of a laser weapon cartridge in a ballistic weapons system 103 attempting to engage a maneuvering weapon 101. In an embodiment, maneuvering weapon 101 may be assessed to be a threat, and ballistic weapon 103 may be fired at the maneuvering weapon 101 in a direction towards position 107 because it may need to compensate for the finite time of flight of the ballistic ordnance. An additional source of uncertainty may be associated with the fact that the maneuvering weapon 101 may not travel in a straight path between positions 105 and 107, as illustrated, and therefore firing in a direction towards position 107 at a time when maneuvering weapon 101 is at position 105 may miss the target. In some embodiments, the weapon 101 may not be maneuverable.

In an embodiment, to reduce the time of flight and induced errors, an energy beam may be directed toward maneuvering weapon 101 at or near the speed of light. For example, a beam of laser light traveling at the speed of light may be fired substantially directly at position 105 in order to destroy maneuvering weapon 101.

In an embodiment, a laser weapon cartridge system may be used which utilizes existing weapons system resources. In particular, it may be desirable to use a laser weapon cartridge that utilizes existing ballistic weapons systems. In certain embodiments, a ballistic weapons system may be utilized which may otherwise be ineffective for defense against missiles. An embodiment of a laser weapon cartridge disclosed herein is generally described relative to naval weapons systems; however, it will be clear to those familiar with the art that such embodiments are readily adaptable to use with other, non-ship based weapons systems as well. The naval weapons system is chosen for this discussion since in some ways naval deployment presents certain unique challenges. In some embodiments, the laser weapon cartridge system may be used without a supporting weapon system. In certain embodiments, it may be desirable to develop a separate weapons system utilizing embodiments of a laser weapon cartridge as disclosed herein. For example, it may be desirable to create target and/or aiming systems specifically for the laser weapon cartridge. In another example, it may be desirable (e.g. for land-based systems) to make a "gun" specifically designed to fire laser weapon cartridges as disclosed herein.

Figure 2:
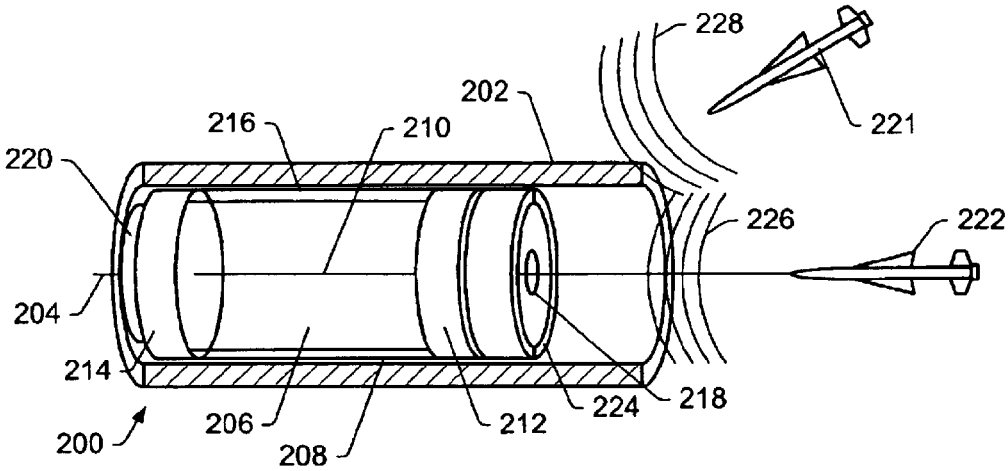
FIG. 2 shows a laser weapon cartridge, according to an embodiment.

FIG. 2 depicts an embodiment of a laser weapon cartridge 200 configured to be fired from a position inside the barrel 202 of an existing ballistic weapon (e.g., a naval gun, tank, artillery gun, etc.). By configuring laser weapon cartridge 200 to be fired from inside the barrel of an existing ballistic weapon, the existing weapon's targeting and aiming systems may be utilized thereby minimizing or eliminating the need for weapons systems modifications. As used herein, "targeting" generally refers to determining the position of a target and/or estimating the future position of a target. Thus, targeting systems may include, but are not limited to, electromagnetic transmitters and/or receivers (e.g., passive and/or active surveillance radar systems), optical systems (e.g., optical sights) or other supporting sensors or sensor/transmitter combinations (e.g., SONAR, laser illumination). As used herein, "aiming" generally refers to pointing a weapon toward a desired location. In some embodiments, laser weapon cartridge 200 may also be configured to be operable via the triggering mechanism of the existing ballistic weapon. For example, laser weapon cartridge 200 may be configured to receive input via firing pin 204 to arm and/or fire laser weapon cartridge 200.

In an embodiment, laser weapon cartridge 200 may be configured for use with a 5" Naval gun (e.g., 5"/54 or 5"/62 naval gun). Although laser weapon cartridge 200 is described herein as interacting with 5" naval guns, it is anticipated that other configurations of the laser weapon cartridge may also be desirable. For example, embodiments disclosed herein may be scalable to other weapons systems (e.g., field artillery systems, airborne weapons systems, space-based weapons systems and/or naval weapons having a larger or smaller diameter). To accurately fire laser weapon cartridge 200, the gun's targeting and/or aiming systems may be configured in an embodiment to aim the existing ballistic weapon substantially along an optical line-of-sight to the target. That is, in some embodiments, the gun may be aimed substantially at point 105 to hit target 101 (as shown in FIG. 1). Typically, existing ballistic weapons may have an aiming system setting for aiming substantially along an optical line-of-sight for use with aiming system calibration and alignment.

In some embodiments, laser weapon cartridge 200 may have similar dimensions to an existing powder can (or canister) used with normal ordnance, so that loading and extraction of the laser weapon cartridge 200 may be achieved with existing capabilities. In an embodiment, laser weapon cartridge 200 may include a laser cavity 206, disposed within a body 208. In certain embodiments, laser cavity 206 may extend along optical axis 210. In some embodiments, one or more mirrors (e.g., 212 and 214) may face each other from opposite ends of laser cavity 206. In some embodiments, at least one mirror (e.g., mirror 212) may be configured to allow at least a portion of light generated within laser cavity 206 to be emitted along optical axis 210 through optics 218. In some embodiments, a laser initiator 216 (e.g., a photoflash device) may be configured to direct at least one pulse of light toward laser cavity 206 to initiate the laser. In an embodiment, laser initiator 216 may be fired by a processor 220. In some embodiments, processor 220 may be armed by firing pin 204.

In some embodiments, after being armed, processor 220 may fire laser weapon cartridge 200 in response to a signal indicating that a desired target 222 is substantially aligned with optical axis 210. For example, in an embodiment, laser weapon cartridge 200 may include one or more antenna elements 224. In some embodiments, antenna elements 224 may detect electromagnetic energy 226 (e.g., radio frequency (RF) energy) emitted by and/or reflected from target 222. In an embodiment, barrel 202 may act as a wave guide for antenna elements 224. Thus, in some embodiments, antenna elements 224 may be shielded from electromagnetic energy 228 emitted by and/or reflected from target 221 and directed at an angle with respect to optical axis 210.

In an embodiment, laser weapon cartridge 200 may be triggered based on RF energy from a threat or a ship's sensing systems. In some embodiments, processor 220 may be configured to account for multiple scenarios enabling adaptive threat engagement. In certain embodiments, a first scenario, referred to herein as "passive acquisition," may include an antenna 224 to receive RF energy originating from the threat (e.g., from the seeker onboard an RF guided missile). In an embodiment, processor 220 may be configured to classify and/or otherwise recognize specific hostile missile seeker signals-of-interest (SOI). Typically, such missile seekers may be in operation while the missile is still at a significant distance from its intended target (e.g., a ship) to enable the missile to set a course substantially ensuring that the missile will hit the intended target. Directing RF energy toward an object to enable targeting the object is referred to herein as "illumination" or "illuminating" the object. In various embodiments, after the missile has set a course to the intended target, the seeker may be turned off and maneuvering may begin. By turning off the seeker and maneuvering, the missile may reduce the effectiveness of certain anti-missile defense systems. For example, one common maneuver may include reducing the altitude of the missile in an attempt to obscure the missile from the target's radar systems as a result of sea scatter effects. Thus, in some embodiments, by configuring laser weapon cartridge 200 to detect and classify a specific seeker SOI, laser weapon cartridge 200 may be able to exploit line-of-site opportunities during threat missile illumination of the ship.

In a second engagement scenario, referred to herein as "Bi-static Acquisition," a missile threat may approach the ship at low elevations with its seeker inactive. In this embodiment, the ship's targeting radar (e.g., continuous wave illumination fire control radar) may illuminate the incoming threat missile. In some embodiments, the ship's weapons control system (e.g., a fully integrated combat system, such as, but not limited to, AEGIS) may aim a gun including laser weapon cartridge 200 at the threat. The laser weapon cartridge's antenna(s) may receive the RF energy returns from the threat.

In an embodiment, bi-static returns may also be detected from other emitters onboard the ship, or on other weapon platforms (e.g., other ships, aircraft, ground-based stations, etc.), if another emitter happens to be illuminating the target. For example, the laser weapon cartridge may detect returns from the ship's close-in weapons system (CIWS) fire control radar.

In various embodiments, processor 220 may process the signal returns detected by antenna(s) 224 to track the relative alignment of the incoming threat with optical axis 210. In some embodiments, down converters, filters, low-noise amplifiers, and multichannel digitizers may also be used. In some embodiments, engagement algorithms utilized by processor 220 may seek out the characteristic rhythm of the target's motion relative to optical axis 210. In some embodiments, based on the target's relative motion, processor 220 may assess an appropriate moment to trigger the lasing sequence to attain a desirable beam alignment with the target. In various embodiments, the processor may provide a trigger signal to ignite the chemical laser and transmit a pulse of energy to the target when the phase front of the reflected signals from the target align perpendicular to the receiving antenna 224 and laser axis 210.

In an embodiment, laser weapon cartridge 200 may also include a manual triggering override. For example, manual triggering may be useful against small surface targets within line-of-sight. An example of such a case when manual triggering for defense against a small, line-of-sight target may be desirable may include the case of a small watercraft rapidly approaching a ship (e.g., fast suicide boat). In such embodiments, laser weapon cartridge 200 may be aimed toward the target using an optical sight coupled to the gun. For example, the Navy's Remote Optical Sight System may be used. In such a scenario, the firing pin may revert to its original use, that is, to transmit a firing order to processor 220, and trigger the laser or directed-energy device.

Typically, a hard kill capability may be desired. However, a soft kill capability may also be beneficial. As used herein, a "hard kill" generally refers to destroying a target. As used herein, a "soft kill" generally refers to disabling at least a portion of a target. For example, a soft kill may eliminate a missile's ability to maneuver or lock on to a target. Generally, a soft kill may inhibit a missile from hitting the missile's target or enable other defense mechanisms to achieve a hard kill of the missile. For example, by eliminating a missile's ability to maneuver, a ballistic weapons system (e.g., the CIWS) may be able to successfully engage the missile. In an embodiment, laser weapon cartridge 200 may be reconfigurable. That is, new program instructions may be loaded into processor 220 to modify targeting and/or firing routines. Additionally, as new threat types are identified, information for characterizing the new threats may be loaded into processor 220. Such embodiments may allow unspent laser weapon cartridges that have already been deployed with a ship to be reconfigured. In certain embodiments, processor 220 may be configured to be quickly reconfigurable. Such embodiments may allow threat-specific engagement logic refinements.

In an embodiment, a very high performance signal processor may be used to perform the threat tracking and laser weapon cartridge triggering functions of processor 220. In certain embodiments, per unit cost of laser weapon cartridge 200 may be reduced by utilizing field-programmable-gate-arrays (FPGAs) for processor 220. In certain embodiments, low per-unit-cost re-configurable digital processors may generally be considered cheap enough to be expendable; however, in certain embodiments, processor 220 may be recoverable for reuse from laser weapon cartridge 200 after firing.

In an embodiment, laser weapon cartridge 200 may include a chemical laser. For example, laser weapon cartridge 200 may include an explosively-driven laser. In general, a chemical laser may produce a laser beam by reaction of two or more chemicals, which produce photons of light upon reaction. Examples of chemical lasers include, but are not limited to: hydrogen-fluoride (HF) lasers, deuterium-fluoride (DF) lasers, and chemical oxygen-iodine lasers (COIL). An HF laser may produce photons via reaction of fluorine and hydrogen (or suitable fluorine atom and hydrogen atom source chemicals). A DF laser may produce photons via reaction of fluorine and deuterium (or suitable fluorine atom and deuterium atom source chemicals). A COIL laser may produce photons via reaction of oxygen and iodine (or suitable oxygen atom and iodine atom source chemicals). In some embodiments, reactants may be stored onboard laser weapon cartridge 200. For example, sufficient reactant quantities may be stored onboard laser weapon cartridge 200 to allow laser weapon cartridge to be fired once. In certain embodiments, chemical reactants may be stored in laser cavity 206.

A laser included in laser weapon cartridge 200 may generally kill a target by causing spalling of the target surface. In some cases, spalling may cause an outer skin of the target to tear, resulting in a catastrophic failure of the target (i.e., a hard kill). In some cases, spalling may propagate inward, damaging the seeker and/or electronics of the target to the point that the target may not engage in complex evasive maneuvers (i.e., soft kill). In such cases, eliminating maneuvering may allow a close-in weapon system (e.g. the CIWS) to track and kill the target.

In an embodiment, antennas 224 may be used to assess if a planar RF phase front is being presented to the antenna. A planar RF phase front may be presented, for example, when RF and optical axes are coincident. In some embodiments, antennas 224 may be affected by scattering effects of the gun barrel. For example, the barrel may channel and focus the RF energy such that the directivity of the antennas in the direction of the threat missile is greatly improved relative to the directivity of the antennas alone. By approximating the gun barrel as a circular wave-guide and by employing geometrical optic approximations and asymptotic diffraction techniques (such as the Uniform Geometric Theory of Diffraction—UTD), reasonably reliable predictions of antenna directivity may be made.

In some embodiments, the directivity afforded by the laser weapon cartridge antenna array disposed within the gun barrel may minimize RF multi-path related errors associated with propagating over seawater at (near horizon) low elevation angles. Additionally, the design of the horizontal and vertical polarization-specific antenna elements may somewhat help minimize RF multi-path related errors.

Figure 3:
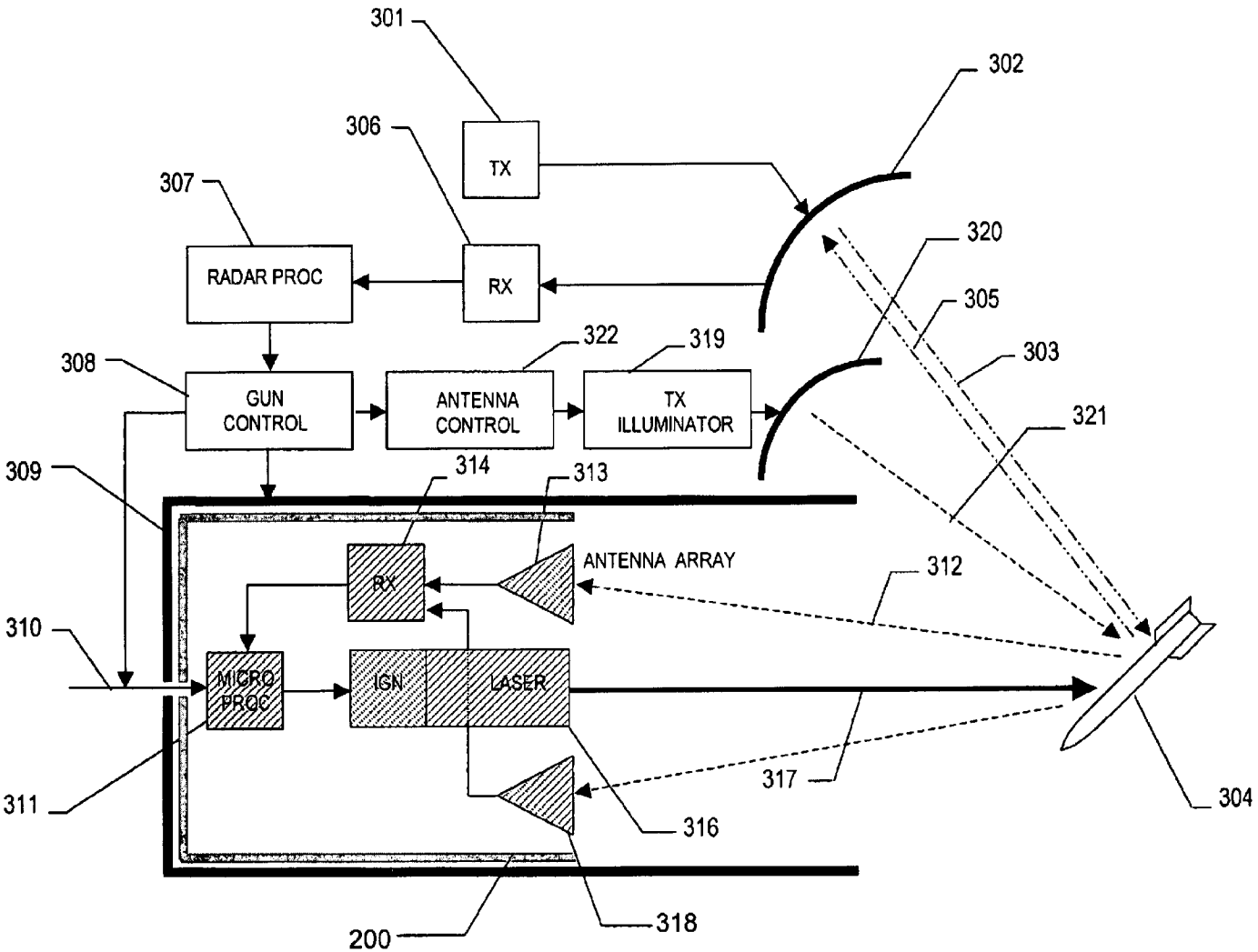
FIG. 3 shows interaction between various components of a laser munition system embodied within a gun barrel and its associated weapon system sensors.

Referring to FIG. 3, an embodiment of a directed energy weapon is illustrated. In an embodiment, a radar system may use a transmitter 301, a radar antenna 302, a receiver 306, and a radar processor 307. In certain embodiments, the radar system may transmit a signal 303 to target 304. Target 304 may reflect at least a part of signal 303 as signal 305. At least a part of signal 305 may be reflected towards radar antenna 302. The received signal may be detected in receiver 306 and processed in radar processor 307 to give signals to the gun control 308 that may aim the gun 309 to align with the target 304. In some embodiments, the ballistics portion of the gun control processing normally required for projectile firing may be turned off during this event so that the gun is pointed directly at the target. In some embodiments, the alignment of the gun barrel 309 by radar control with the target 304 generally is not sufficiently precise to ensure successful laser firing. The radar may provide sufficient control to maintain the target 304 within an error circle that is much smaller than the optical opening of the barrel as viewed from the breech end of the barrel. The laser system may be armed by an arming command 310 via the firing pin. In some embodiments, the arming may cause the microprocessor 311, antenna arrays 313 and 318, and receiver 314 to become activated. Since the target 304 is aligned close to boresight, a portion of the radar signals 303 impinging on the target 304 may reflect as signal 312 into the barrel and onto the antenna array 313 and/or 318. In some embodiments, the antenna signals may be processed in the microprocessor 311. In various embodiments, the antenna array elements 313 and 318 may be arranged to be sensitive to the phase front of the incoming signals 312. In some embodiments, the relative target position may move randomly about boresight, which results in a varying distribution of signal phasing across the plane of the antenna arrays 313 and 318. In some embodiments, when the phases of the antenna signals become closely matched, the microprocessor 311 may create a trigger pulse to ignite the laser 316 to form a high-energy pulse 317 toward the target.

In various embodiments, if it is assessed that the incoming missile is self seeking (e.g., if the incoming missile radiates a homing signal) the laser system may be commanded through the triggering mechanism to monitor the signals from the seeker rather than those reflected by a ship-borne radar. In some embodiments, if necessary, a friendly source of radiation, such as, but not limited to, a gun director may be used to illuminate the missile to provide reflected energy that can be used for laser triggering. In some embodiments, the radar system depicted (consisting of 302, 301, 306, and 307) may have a low revisit rate on target 304, resulting in the target being infrequently illuminated with RF energy 303. In such situations the primary radar system (302, 301, 306, 307) may be used to assess target coordinates. In some embodiments, to insure continual or highly frequent backscatter 312 to the antenna array elements 313 and 318, a separate, dedicated transmitter 319 and illumination antenna 320 may be used to illuminate 321 the target with RF energy. In some embodiments, the illumination antenna 320 may receive its target coordinates from the primary radar system (302, 301, 306, 307, e.g. an AEGIS Weapon System, AWS). In some embodiments, AWS, in turn points 322 of the illumination antenna 320 to provide more consistent RF backscatter to the antenna array (313, 318). The signal processor may contain various formats for discriminating against interfering signals that could disrupt accurate triggering.

In certain embodiments, known formats of illumination signals may be programmed into the laser microprocessor. The specific format known before triggering may be selected in the microprocessor by a command code through the triggering mechanism. The use of a specific format that correlates with the format of an incoming signal may provide processing gain that improves the received signal-to-noise ratio.

In various embodiments, the laser system may permit manual triggering that overrides the automatic self-triggering. In some embodiments, an override command through the triggering mechanism may arm the system for manual or external activation of laser firing. This operational mode may allow the weapon to be directed onto very close-in targets at distances less than the operational range of the radar.

Figure 4:
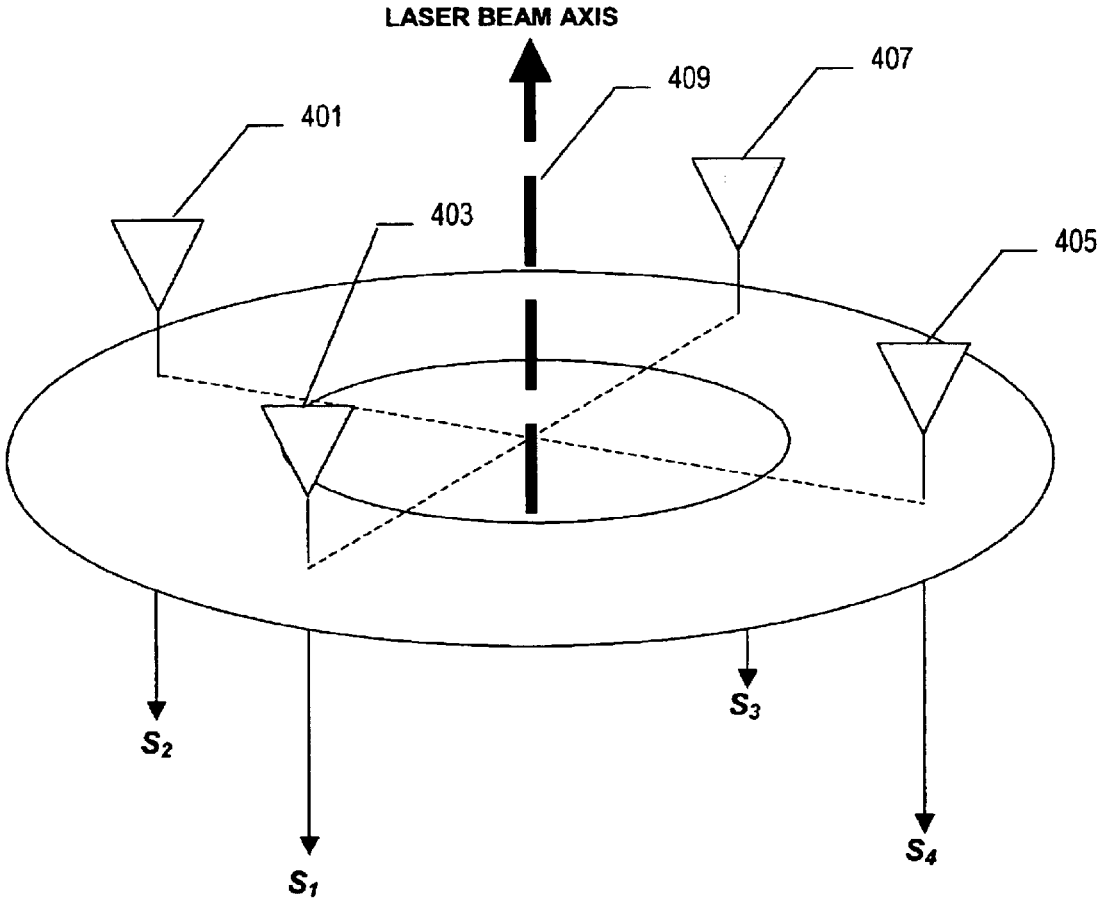
FIG. 4 shows a laser beam axis relative to four antenna elements, according to an embodiment.

Referring to FIG. 4, in various embodiments, the laser weapon cartridge may activate the laser at a precise moment when the target is located within a lethal circle centered on the laser axis 409. In some embodiments, the laser axis 409 may be closely aligned with the gun barrel axis based on individual, canister-specific RF/optical calibration alignment procedures and manufacturing of the laser/antenna assembly within each canister. This alignment may be sufficiently close so that the pointing of the gun barrel to the target under radar control also corresponds to near alignment of the laser axis 409 with the target. In some embodiments, the radar control of the gun aiming may be imprecise by a few minutes of arc off boresight, which may be too broad to ensure successful laser firing. In some embodiments, the barrel aiming may, however, maintain the target well within the optical window opening at the mouth of the barrel. This positioning may allow signals from the target to enter the barrel and propagate its length to the forward end of the weapon canister. In some embodiments, an antenna array may include elements such as, but not limited to, antenna elements 401, 403, 405, and 407 at the forward end of the weapon canister to receive signals entering the barrel. In various embodiments, antennas 401, 403, 405, and 407 may be situated in a quadrature arrangement such that the received signals ($S_1$, $S_2$, $S_3$, $S_4$) from the several antenna elements can be processed to assess the angle of the signal phase plane relative to the laser axis 409.

In some embodiments, it may be desirable for the antennas to provide a good null on bore-sight. As used herein, a "null" or "null pattern" generally refers to a relatively small remaining signal when signals received by two or more antennas are compared to one another. Specifically, in some embodiments, a null value may be assessed by subtracting a signal received by a first antenna element from a signal received by a second antenna element. Thus, if the first and second antenna elements are receiving signals with identical properties (e.g., phase, strength, frequency, etc.) the two signals may substantially cancel one another, resulting in a null.

In various embodiments, during an active mode of homing on a target, the target may be "seen" moving about the boresight axis randomly in azimuth and elevation. In some embodiments, this random motion may be the result of target maneuvering and imperfect tracking and pointing control by the radar/gun control systems. In some embodiments, this random motion may cause the target to pass across the axis or close to the axis. In some embodiments, the lethal region of the laser beam may be an angular circle about the laser axis that may be smaller than the circle containing target motion. In some embodiments, the antennas 401, 403, 405, and 407 in the array may continually monitor the signal entering the barrel from the target. In some embodiments, the phase difference between diametrically opposed antenna elements 403 and 407 may be assessed. Also, the phase difference between diametrically opposed antenna elements 401 and 405 may be assessed. In some embodiments, antenna elements 403 and 407 may be aligned perpendicular to elements 401 and 405. In some embodiments, a zero phase difference between elements 403 and 407 may correspond to a target position in the plane containing the laser beam and the perpendicular to the axis between these elements. Similarly, a zero phase difference between elements 401 and 405 may correspond to target position in the plane containing the laser beam and the perpendicular to the axis between these elements. In some embodiments, a zero phase difference occurring between both sets of antennas simultaneously may correspond to the target on the laser axis 409. In some embodiments, when the relative target motion causes the target to come within the region of lethality about the laser axis 409, the phasing on the antenna elements 401, 403, 405, and 407 may indicate that the target is sufficiently close to the laser axis 409 to permit firing.

Figure 5:
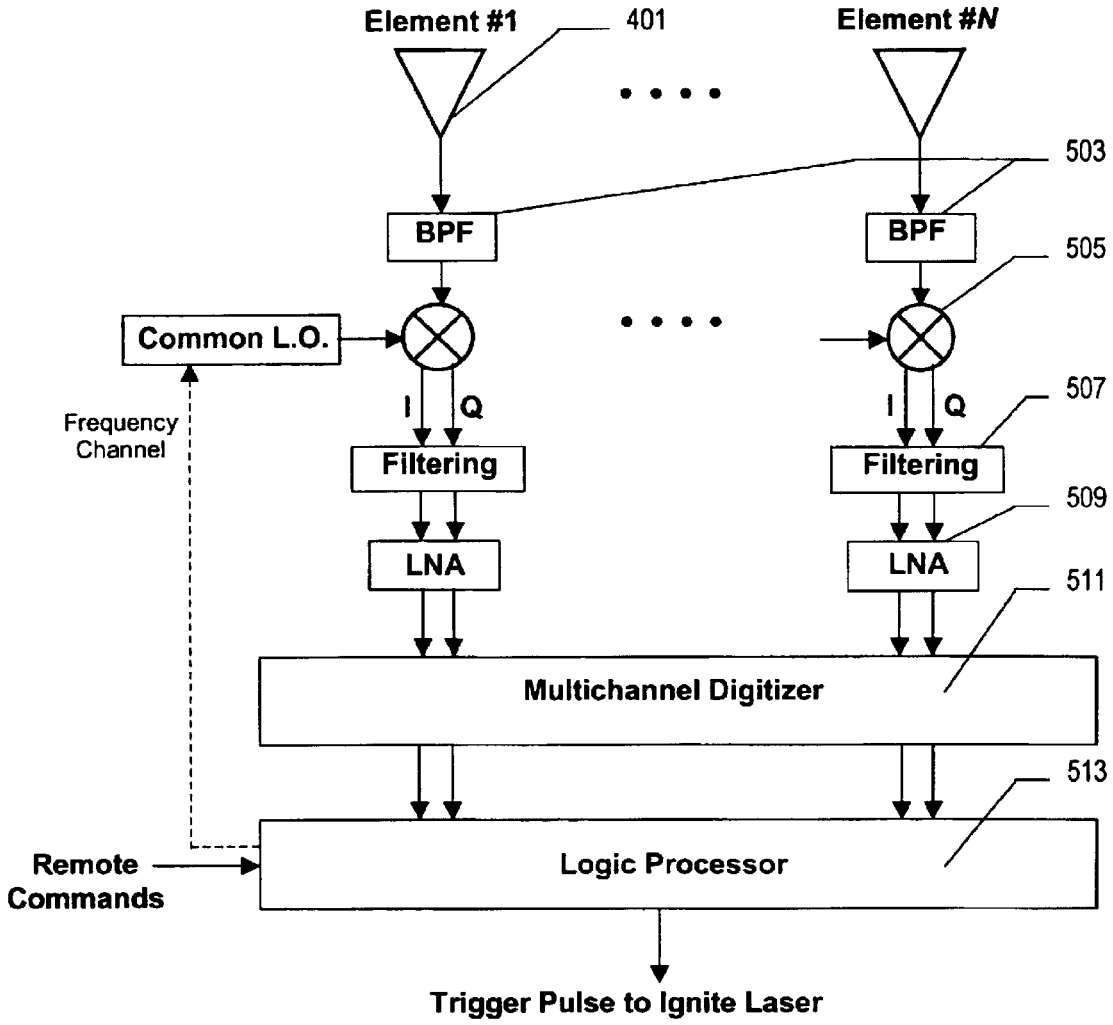
FIG. 5 shows a block diagram for antenna element signal processing, according to an embodiment.

FIG. 5 illustrates a block diagram of an embodiment of how signals from the antenna elements are processed. The antenna array need not be restricted to just four, as shown in FIG. 4, but may consist of N elements. In some embodiments, the received signals from the elements may be processed the same. In some embodiments, the signals may pass first through band-pass filters 503 to remove extraneous interfering signals and noise. In various embodiments, the signal may then be converted down to an intermediate frequency (IF) by a local oscillator 505 that may be common to all antenna signals. In this manner, the relative phases among the antenna signals may be preserved in the IF. In some embodiments, the down conversion may be performed using two oscillator signals in quadrature to generate both In-phase (I) and Quadrature-phase (Q) components of the antenna signals. The amplitudes of these two components may provide the signal phase θ through the relationship $\tan\theta = Q/I$. In certain embodiments, further filtering 507 may remove unwanted mixing products and may narrow the IF to its useable bandwidth. In some embodiments, the signals may then be amplified with Low-Noise Amplifiers 509 before being sampled by a multi-channel digitizer 511. In some embodiments, the digitized signals may be input to a Logic Processor 513 that assesses when a trigger pulse should be generated to ignite the chemical laser for a successful hit.

Figure 6:
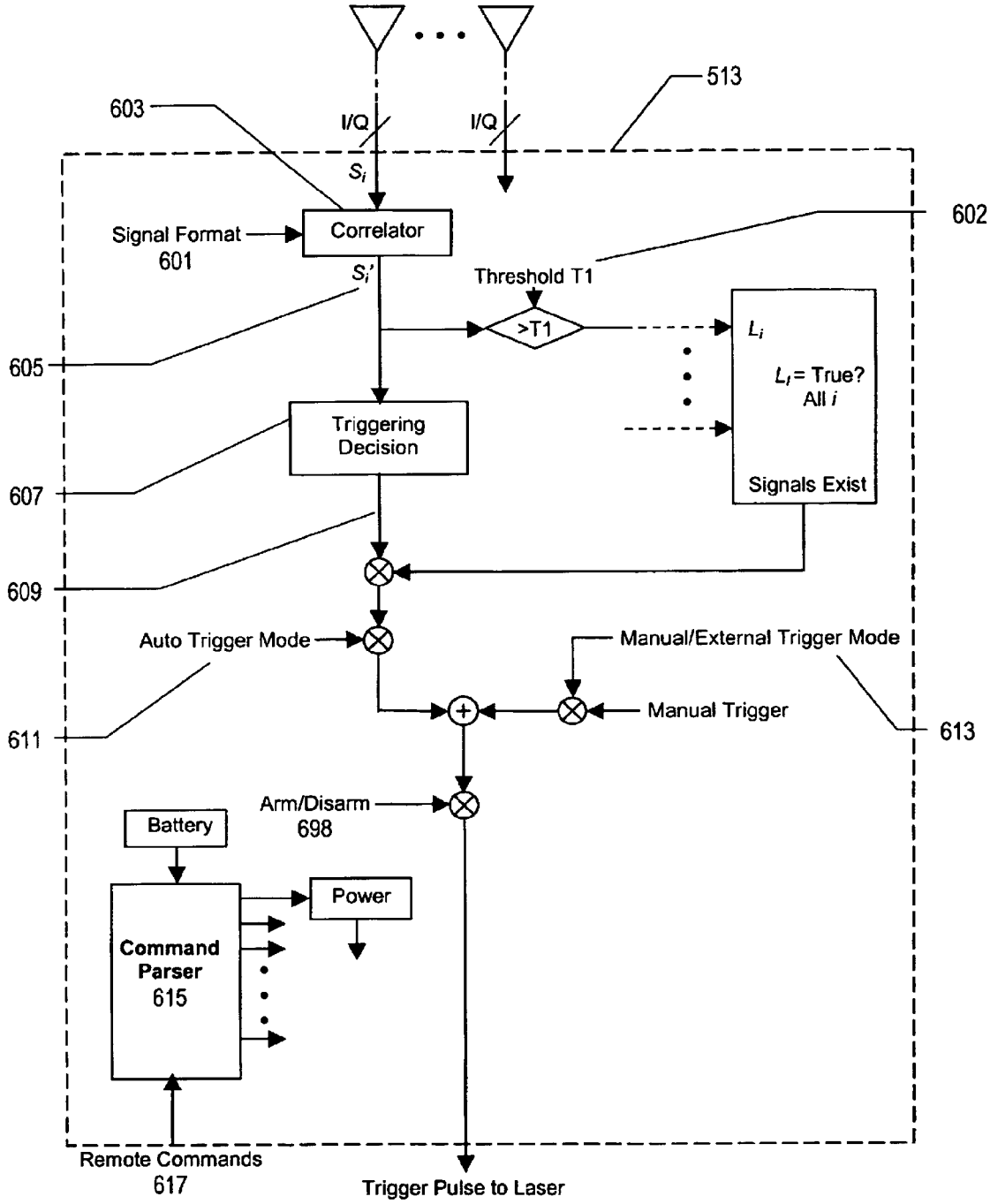
FIG. 6 provides details of a logic processor, according to an embodiment.

FIG. 6 shows an embodiment of a logic processor 513 receiving I and Q digitized signal samples from the N antenna element channels via the multi-channel digitizer. In some embodiments, the logic processor 513 contained within the munitions canister may be used in the system that provides control of automatic triggering of the laser. In some embodiments, one function of the processor may be to make a decision to trigger the laser when the target is aligned with the laser axis.

In some embodiments, signal channels may be preset within the weapon logic to correspond with various radar system, gun directors, and missile self-seekers. In some embodiments, the signal channel command may set the local oscillator to the appropriate frequency to convert the desired frequency band to the IF. The signal format 601 command may permit the selection of one of several preset formats that may be used to discriminate a particular known signal from other signals that may interfere. In some embodiments, the microprocessor may correlate the format with an incoming signal having the same format to provide processing gain and help extract the signal out of the noise.

In various embodiments, the digitized I and Q signals from each of the antenna channels may pass through a correlator 603 that may improve the signal-to-noise ratio by extracting the desired signals from interference and noise according to a known format of the received signal. In some embodiments, a known signal format 601 of an illuminating signal may be pre-stored in the processor and used in the correlator 603 for identifying the desired signal within interference and noise also present during an attack. In some embodiments, specific formats of self-guided missiles, also included within the format list, may be applied to the correlator 603 if the format is detected early in the attack process. In some embodiments, the processor may be capable of determining an unknown signal format 601 and storing it within the logic for correlating with the target signal during the final phases of its approach.

In some embodiments, the processed antenna signals $S_i'$ 605 at the output of the correlator 603 may be monitored to assess if a signal from the target is present. In some embodiments, the signal amplitudes from each antenna channel may exceed a commanded threshold level T1 602 for the decision to be made that a signal exists. This may be an additional safety feature that prevents the triggering logic from firing the laser prematurely when all logic conditions could be met in the absence of a signal.

In various embodiments, the heart of the logic processor 513 may lie in the triggering decision box 607. In some embodiments, two types of decisioning may be used. In some embodiments, in order for the Logic Processor to differentiate between different triggering requirements, the device may use a means of parsing various command sequences sent to it. In some embodiments, the logic processor 513 may have an external connection 617 outside the munitions canister to receive remote commands from an operator. In some embodiments, the remote commands may be processed by the command parser 615 within the logic processor 513.

Figure 7:
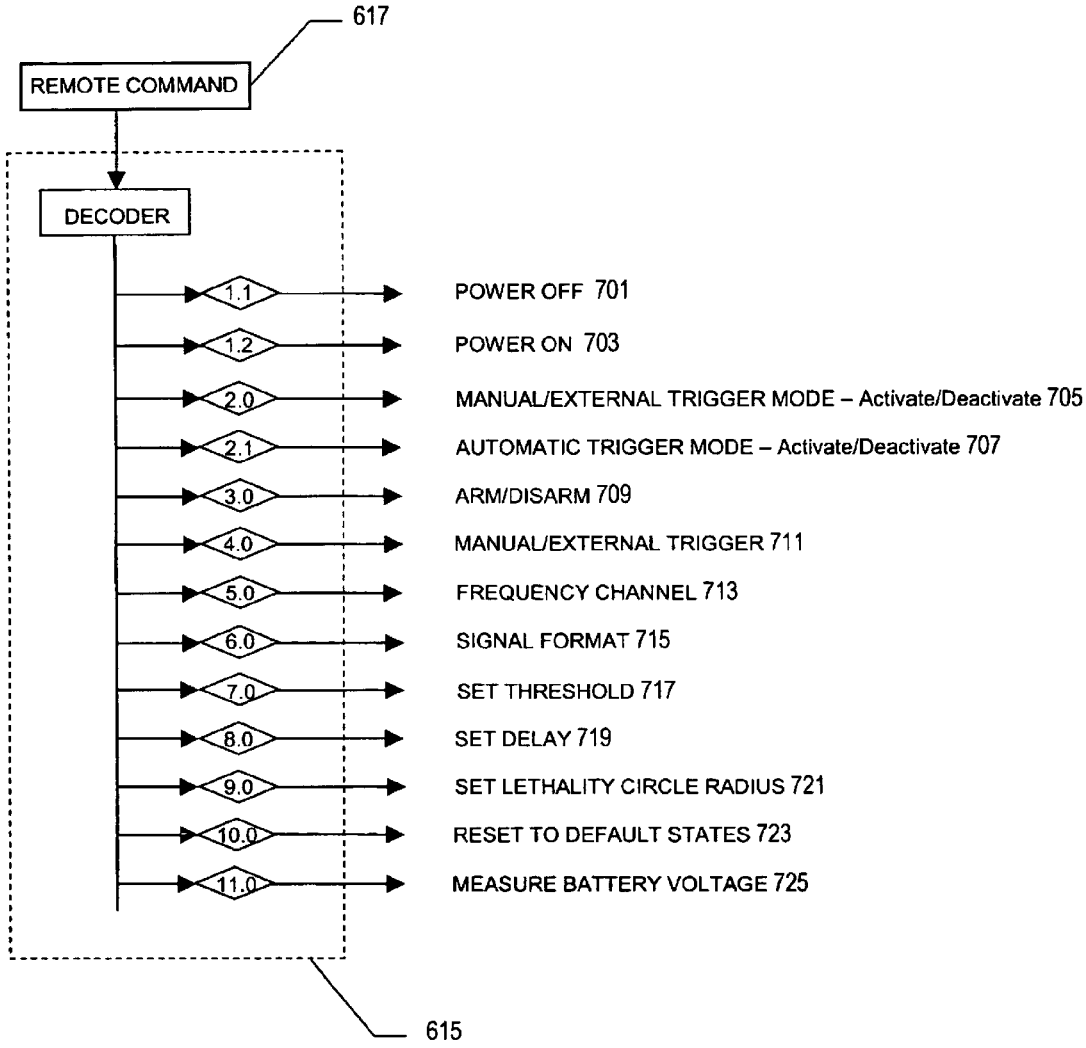
FIG. 7 provides details of a remote command processing parser, according to an embodiment.

FIG. 7 shows an embodiment of the laser weapon cartridge system capable of receiving remote commands 617 electrically through a connector, for example, at the base of the canister where the firing pin 204, in FIG. 2, may be located. In various embodiments, commands may be entered before the canister is loaded into a gun and, also, after it is loaded within the breech, where the commands may be sent through the firing pin assembly normally used for electrical firing pins. In some embodiments, remote commands may enter the command parser 615, which may be battery activated. The commands may include:

a) Power On/Off 701/703—Electrical circuits within the munition system may be activated or deactivated from an internal battery;

b) Manual/External Trigger Mode Activate/Deactivate 705—The manual or external trigger mode may be activated or deactivated;

c) Automatic Trigger Mode Activate/Deactivate 707—The automatic trigger mode may be activated or deactivated;

d) Arm/Disarm 709—The laser may be enabled to be fired by manual/external or automatic triggering, or may be disabled from being fired;

e) Manual/External Trigger 711—Laser may be ignited manually;

f) Frequency Channel 713—The specific frequency channel of signals received from target may be selected;

g) Signal Format 715—The specific signal format of signals received from target may be selected including command code for no signal format. In addition, code for adaptively learning the format of current signal from target may be included;

h) Set Threshold 717—The level of one or more signal thresholds may be entered;

i) Set Delay 719—The amount of time delay may be entered;

j) Set Angular Radius $\phi$ 721—The lethality circle angular radius may be set;

k) Reset to default states 723—States may be reset to default states; and l) Measure battery voltage 725—The battery voltage may be measured.

Figure 8:
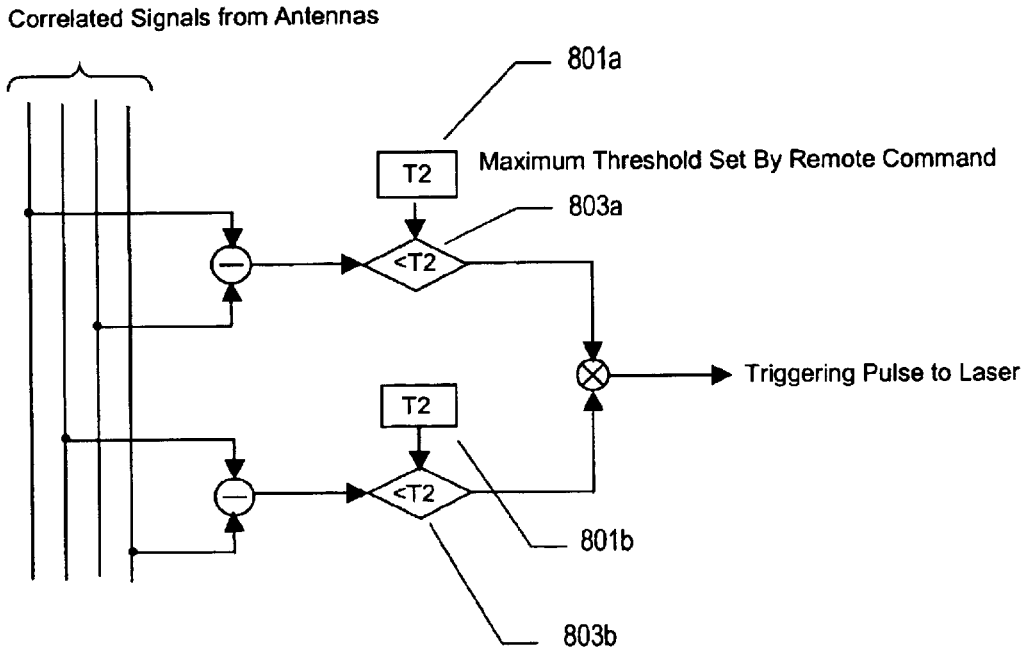
FIG. 8 shows real time triggering decision logic, according to an embodiment.
Figure 9:
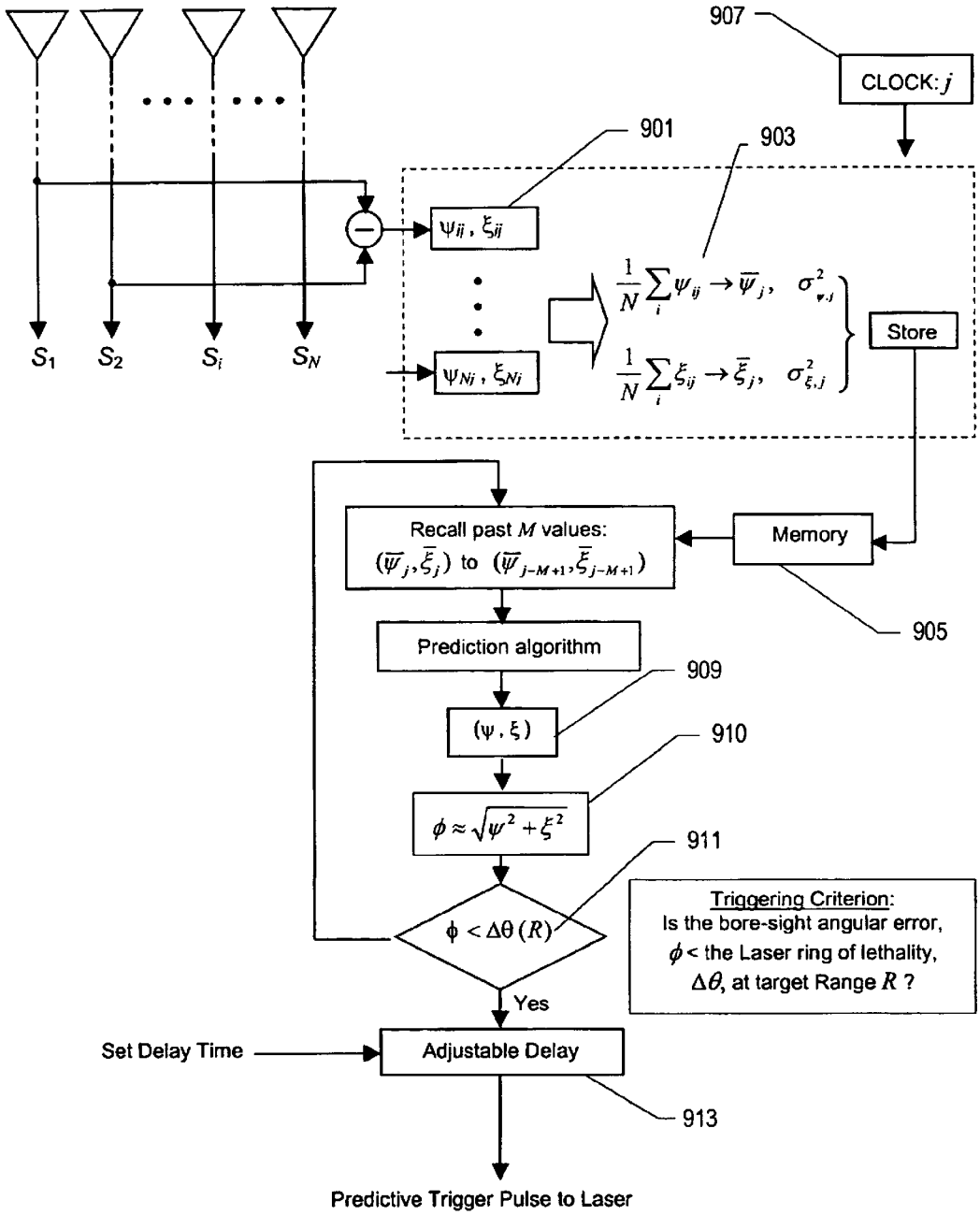
FIG. 9 shows predictive triggering decision logic, according to an embodiment.

Two types of decision processes, according to various embodiments, are further detailed in FIG. 8 and FIG. 9. FIG. 8 shows an embodiment of one type of decisioning: real-time triggering. FIG. 9 shows an embodiment of a second type of decisioning: predictive laser triggering. In various embodiments, the output of the triggering decision 607 in FIG. 6 may be a trigger pulse 609 that is available to ignite the laser. In some embodiments, several logic states may be met before the pulse is sent to the laser. In some embodiments, the decision that a target signal exists may be true. In some embodiments, a trigger mode may be set to either automatic 611 or manual 613. In some embodiments, the auto trigger mode 611 may not be true if the manual trigger mode 613 is true, and, conversely, the manual trigger mode 613 may not be true if the auto trigger mode 611 is true. In some embodiments, the manual trigger mode 613 may allow laser firing by a manual or some other external system trigger command, rather than by automatic triggering. In some embodiments, a true state from either the auto trigger mode 611 or manual trigger mode 613 with manual trigger may present a true state at the arm/disarm gate. In some embodiments, if the arm 698 command has been given, the trigger pulse may be sent to the laser for ignition.

FIG. 8 shows an embodiment of the laser munition that contains a triggering decision logic that may be real time. In some embodiments, the logic process for real-time triggering may use two or more antenna element pairs in the array. Other numbers of antenna elements are also contemplated (e.g., a single moving antenna element). In some embodiments, the antennas may be arranged uniformly around the array circle. In certain embodiments, the logic may be designed to detect the presence of a signal null on the laser axis. In some embodiments, the signal difference between antennas of each diametrically opposed antenna pair may be compared with command threshold T2 801*a,b*. In some embodiments, if the complex amplitudes of the signal differences are less than T2 803*a,b* from both pairs, the triggering state may be True, and a triggering pulse may be generated.

FIG. 9 shows an embodiment of a laser munition using a triggering decision logic that may be predictive. In some embodiments, the antennas or antenna element pairs may be arranged uniformly around the array circle. In some embodiments, periodic measurements may be made of the azimuth angle $\xi$ and elevation angle $\psi$ of the target relative to the laser axis. In some embodiments, the measurements may be made from the difference levels of selected pairs of antennas. In certain embodiments, the angles may be derived from pre-measured relationships between offset angle and signal amplitude in the null region of the laser axis. In various embodiments, within each measurement interval, multiple pairs of antennas may provide a set of $(\psi_{ij}, \xi_{ij})$ values 901 corresponding to one relative position of the target at clock period j. In some embodiments, these values may be either averaged 903 or otherwise combined (e.g. weighted average, etc.) to give a best estimate (means and variances) of the target position. In some embodiments, the position estimate values, assessed from the N estimates, result in a single location estimate $(\overline{\psi}_j, \overline{\xi}_j)$ associated with a certain time-stamp, appropriately labeled as the $j^{th}$ estimate, that is stored in memory 905 at clocked intervals (e.g., based on clock 907).

In various embodiments, the predictive process may be based on the relative variations of the most recent j=M values of $(\overline{\psi}_j, \overline{\xi}_j)$ from memory 905. In some embodiments, the predicted target location at the next time interval may be denoted $(\omega, \xi)$ 909. In some embodiments, these two angles may be orthogonal to each other and may be combined to give the radial angle 910 to the target off the laser axis with the relationship $\phi=(\psi^2+\xi^2)^{1/2}$. In some embodiments, when this angle $\phi$ becomes less than the commanded radius value $\Delta\theta$ of lethality 911, a laser trigger may be generated. In some embodiments, the trigger pulse may be delayed 913 under command to enhance the firing accuracy of the predicted position.

Figure 10:
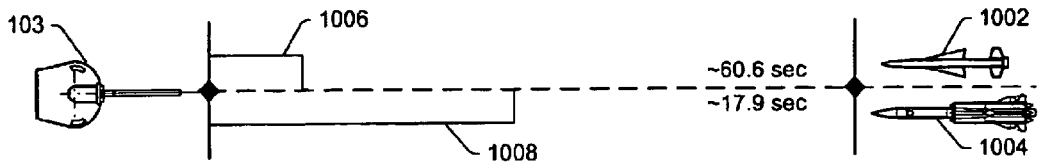
FIG. 10 shows an embodiment of "Golden Shots" (i.e. scenarios with high $P_K$ engagements) for two different ASM threats.

FIG. 10 depicts an embodiment of a simplified engagement example. FIG. 10 illustrates an embodiment of how an engagement strategy for a laser weapon cartridge may change depending on the threat. For example, a "golden shot" may vary depending on the type of threat. Since laser lethality may decrease as a function of increasing range, the laser weapon cartridge may include a shoot-policy that does not preclude taking the shot with the highest probability of kill ($P_K$). As used herein, the shot with the highest $P_K$ is generally referred to as the "golden shot." The golden shot may refer to a shot that intercepts the threat at a close enough range to maximize $P_K$, but at a sufficiently distant range to inhibit the threat (e.g., missile) from damaging the ship. For purposes of illustration, the minimum range to inhibit damage to the ship is illustrated in FIG. 10 as 1 nautical mile (NM). Other minimum ranges are also contemplated. FIG. 10 depicts two different threats that a ship may encounter. The first threat is an Exocet-like missile 1002. The second threat is a super-sonic sea-skimmer missile 1004. Other threats are also contemplated. In an embodiment, threats (e.g., an Exocet-like missile 1002) may typically approach a ship at a low altitude (e.g., several meters) and at high subsonic speeds (e.g., 0.8 Mach). In some embodiments, if a laser weapon cartridge first engages the threat at a range of 10 NM, the weapon may have about 60.6 seconds to kill the target before the threat reaches the 1 NM point. A standard U.S. Navy 5" gun may have a firing rate of 16–20 rounds per minute, or about 3–4 seconds per round. In an embodiment, assuming a 5 second laser weapon cartridge triggering latency, there may be time for about 6 shots at the threat. In an embodiment, the 5 seconds for triggering latency may be a worst-case scenario; it is expected to be generally less than that and will probably decrease with target range. In some embodiments, the "extract-load-arm" cycle may continue until the ship's weapons system assesses that the threat has been destroyed. In the case where the threat is an Exocet-like missile 1002, the golden shot may lie approximately in area 1006. If the threat is a super-sonic sea skimming missile 1004, the shoot-policy may be different. For example, a super-sonic sea skimmer may approach the ship at super-sonic speeds (e.g., about 2.7 Mach). Thus, in an embodiment, the threat may be within an engagement envelope for about 17.9 seconds. With the same assumptions for the laser weapon cartridge engagement and weapons systems capability, in some embodiments, there may be time for about 2 shots. In an embodiment, the golden shot, if the threat is super-sonic sea skimmer 1004, may be approximately in area 1008. In some embodiments for both target scenarios, the engagement scheduler determining the shoot policy dynamically, will not fire just to maximize the number of rounds cycled, but to insure that the all-important "golden shot" (1006 and 1008 with the highest $P_K$) can be taken, while maximizing the number of rounds fired.

Figure 11A:
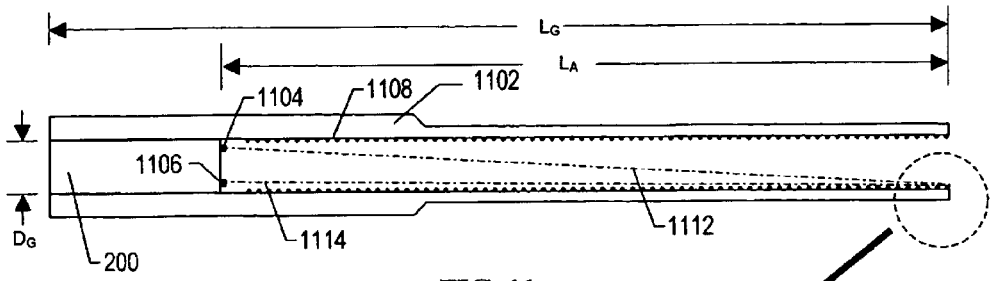
FIGS. 11*a*–11*c* depict a geometric analysis of directivity of an antenna disposed within a gun, according to an embodiment.
Figure 11B:
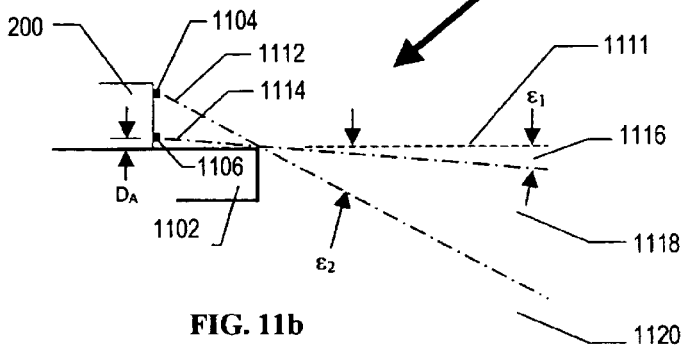

FIG. 11*a* depicts a cutaway view of an embodiment of a laser weapon cartridge 200 disposed within a gun barrel 1102. In some embodiments, antenna elements 1104 and 1106 may be disposed on the front of laser weapon cartridge 200, toward the muzzle of the gun. Gun barrel 1102 may or may not include rifling 1108 along some portion of the interior of the barrel. Gun barrel 1102 has a length, $L_G$, and a diameter, $D_G$. In some embodiments, antenna elements 1104 and 1106 may sit at some distance from the muzzle of the gun, $L_A$, which may be a function of the length of barrel 1102, and the length of the laser weapon cartridge 200 and/or the position of laser weapon cartridge 200 within barrel 1102. In some embodiments, antenna elements 1104 and 1106 may also sit some distance $D_A$ from the wall of barrel 1102, as illustrated in the detail in FIG. 11*b*. Although the dimensions shown in FIGS. 11*a* and 11*b* are not to scale, they are intended to convey the very large length-to-width ratio, which may be present in certain embodiments.

In some embodiments, the gun may be one of the U.S. Navy's standard 5" guns, and $D_G$ may be about 5.12". The U.S. Navy currently employs at least two different 5" guns. The first has a barrel length $L_G$ of about 22'6". The second has a barrel length $L_G$ of about 25'10". Other guns are also contemplated. In some embodiments, to provide adequate space for laser optics, antenna elements 1104 and 1106 may be arranged along the circumference of a circle concentric with the inside of barrel 1102.

In various embodiments, based on the geometry of the gun/laser weapon cartridge arrangement, three angular regions may be defined. FIG. 11*b* depicts an embodiment of a gun/laser weapon cartridge arrangement with the barrel significantly shortened to allow a more unambiguous definition of these angular regions. In an embodiment, ray 1114, a straight line projecting from antenna element 1106 to an edge of barrel 1102 adjacent to antenna element 1106 along a diameter of barrel 1102, may depict a path RF energy may travel to be detected by either antenna element 1104 or antenna element 1106. In an embodiment, ray 1112, a straight line projecting from antenna element 1104 to an edge of barrel 1102 opposite antenna element 1104 along a diameter of barrel 1102 may depict a path RF energy may travel to be detected by antenna element 1104, but optically obscured from antenna element 1106. In an embodiment, boresight line 1111, a straight line projecting parallel to the boresight of the gun along the wall of barrel 1102, and line 1114 may form a first angle, $\epsilon_1$. Similarly, boresight line 1111 and line 1112 form a second angle, $\epsilon_2$.

Figure 11C:
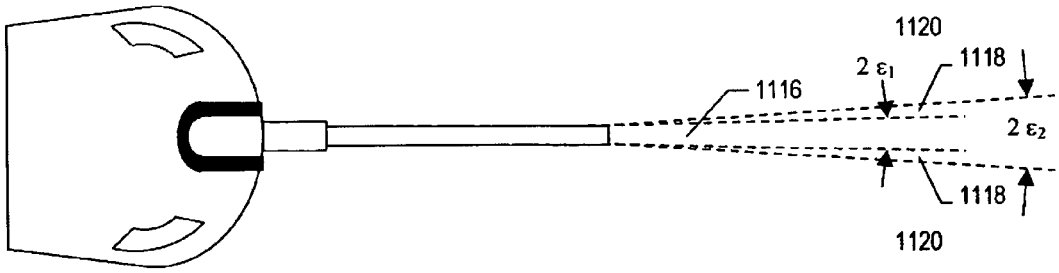

In various embodiments, angles $\epsilon_1$ and $\epsilon_2$ form angular boundaries to define the three angular regions of interest as depicted in FIG. 11*c*. In some embodiments, a first region 1116 may include a cone having a direct view of multiple antenna elements (e.g., at an angle less than about $\epsilon_1$). A second region 1118 may include a cone surrounding first region 1116 (e.g., at an angle between $\epsilon_1$ and $e_2$) wherein one or more antenna elements are optically obscured and one or more antenna elements are in view. In some embodiments, third region 1120 may include the spacing having no direct line of sight to any antenna element (e.g., at angles greater than $\epsilon_2$).

In an embodiment, UTD, an intuitive antenna analysis method, may be used to separate a complex scattering problem into its constituent parts, allowing a better understanding of the phenomena creating the pattern. An example of experimental modeling of the scatter mechanism of the gun/laser weapon cartridge antenna was conducted in free space, and in the presence of a smooth dielectric surface representing the sea surface. In some embodiments, a smooth sea may represent the worst-case scenario for a mono-pulse antenna array from a multi-path error viewpoint. In some embodiments, a rough sea may scatter incident rays in different directions, minimizing the magnitude of the reflected rays, and therefore minimizing the mono-pulse error due to multi-path.

Figure 12:
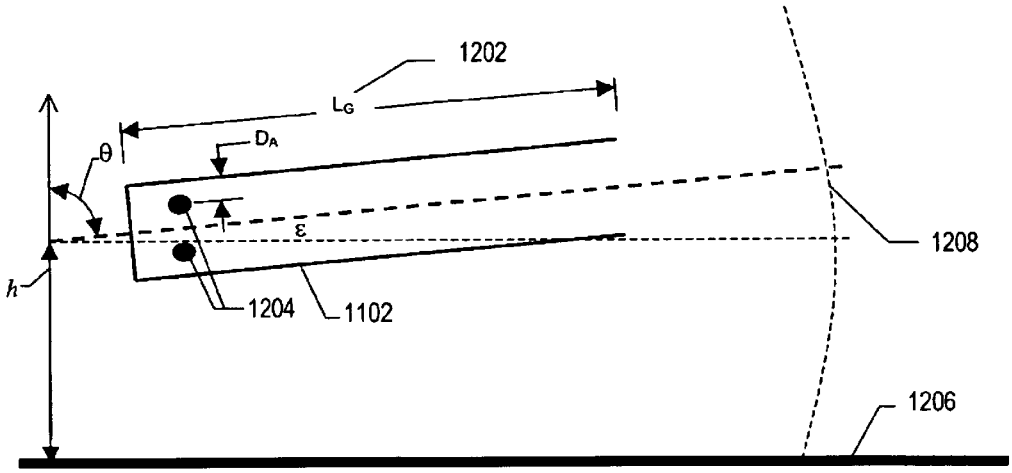
FIG. 12 depicts a geometry for a pair of antenna elements over an infinite half plane, antenna elements within two semi-infinite planes, and antenna elements disposed within a cylinder according to an embodiment.

FIG. 12 illustrates the geometry of a simulation that demonstrates to what degree a vertically polarized mono-pulse antenna may be protected from the undesirable effects of multi-path when contained in a cavity, such as the 5" gun.

In an embodiment, the directivity of two point-sources 1202 (representing antenna elements 1104 and 1106) in a difference (mono-pulse) mode may be assessed with and without a ground plane, contained within two infinitely wide plates with separation, $D_G$=5", or confined to a 5-inch diameter cylinder, $D_G$. In an embodiment, the gun pivot point, h, may be taken to be the height above sea level of a typical existing 5" gun on a U.S. Navy ship. The length of barrel 1202, $L_G$, may be set to length of the current 5"/54 gun (e.g., about 22'6") and the antenna element 1204 locations may be selected to be ½ inch from the walls (e.g., $D_A$ was ½ inch). The conductivity of the barrel walls in the simulation was assumed to be infinite, however, the half plane 1206 over which the overall patterns were computed was assumed to be perfectly smooth but having the dielectric properties of seawater.

Figure 13A:
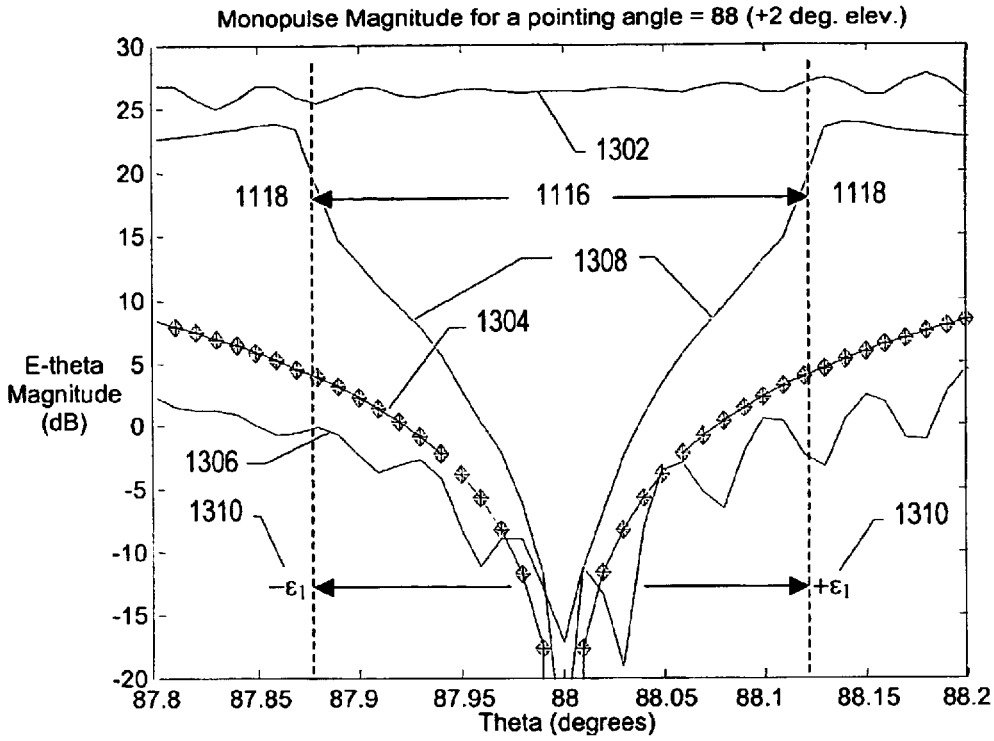
FIGS. 13*a* and 13*b* depict plots of theoretically predicted computational results of directional sensitivity of several configurations of antenna element pairs at two different frequencies (16 GHz and 10 GHz), according to an embodiment.
Figure 13B:
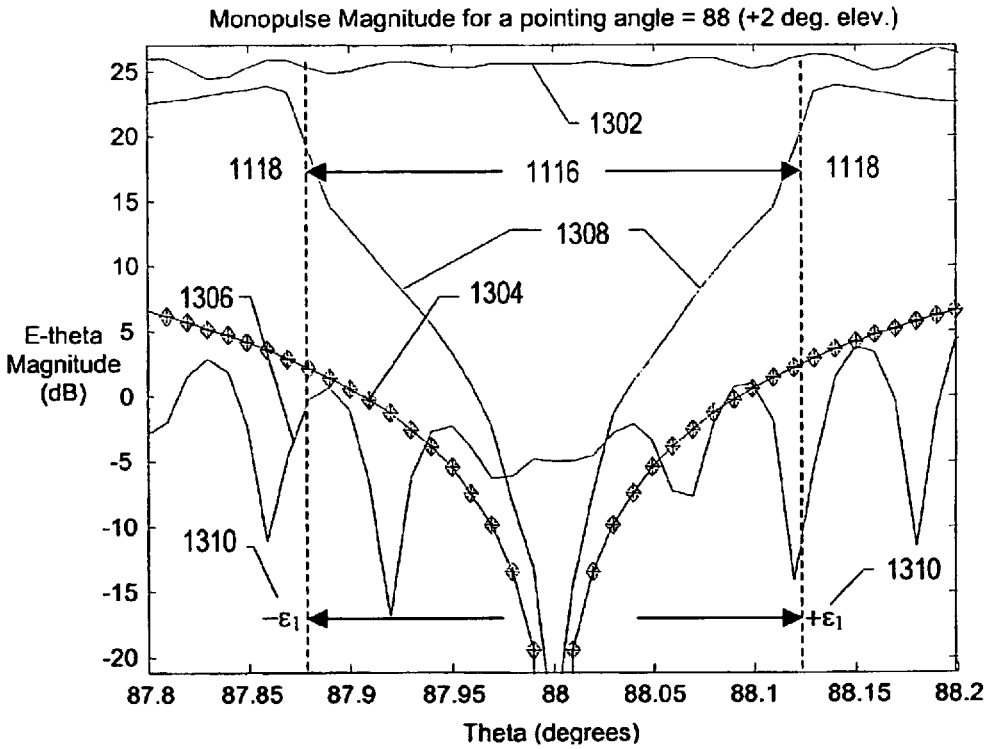

Simulations made at a far field distance 1208 for the dual-antenna element array operated at 16.5 and 10 GHz, are illustrated in FIGS. 13*a* and 13*b*, respectively. In both figures, line 1304 represents the ideal case, in some embodiments, with the antennas in free space with no element shielding and no infinite half-plane present, resulting in a deep null. Line 1302 represents just the antenna elements over the infinite smooth surface, exhibiting no nulls, and therefore no angular resolution capability. Line 1306 represents the antennas between two infinitely wide plates, and that results in at least some improvement over line 1302. Line 1308 represents the antennas within a cylinder (e.g., gun barrel), which results in an excellent null that also shows relative insensitivity to frequency between FIGS. 13*a* and *b* (16 and 10 GHz, respectively) in the (±0.2 degree) angular region shown. Note that angular region 1116, as shown in FIG. 11*c*, is bounded 1310 by $\epsilon_1$ being about 0.12 degrees of boresight; $\epsilon_2$ (bounding region 1118) is just under one degree (therefore, not shown) for the gun dimensions assumed. In the simulation, the pointing angle was set to 88 degrees, as defined in FIG. 12, or a two-degree elevation angle, $\epsilon$, with respect to the horizon.

Figure 14A:
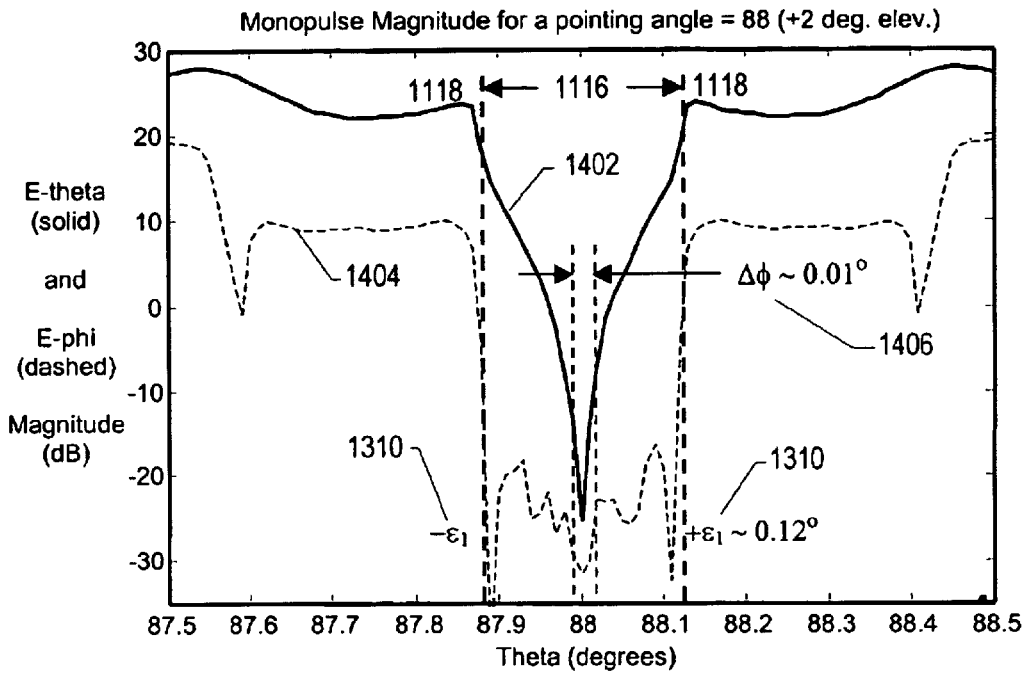
FIGS. 14*a* and 14*b* depict plots of theoretically predicted computational results comparing the primary polarization component with the cross-polarization component of a signal, according to an embodiment.
Figure 14B:
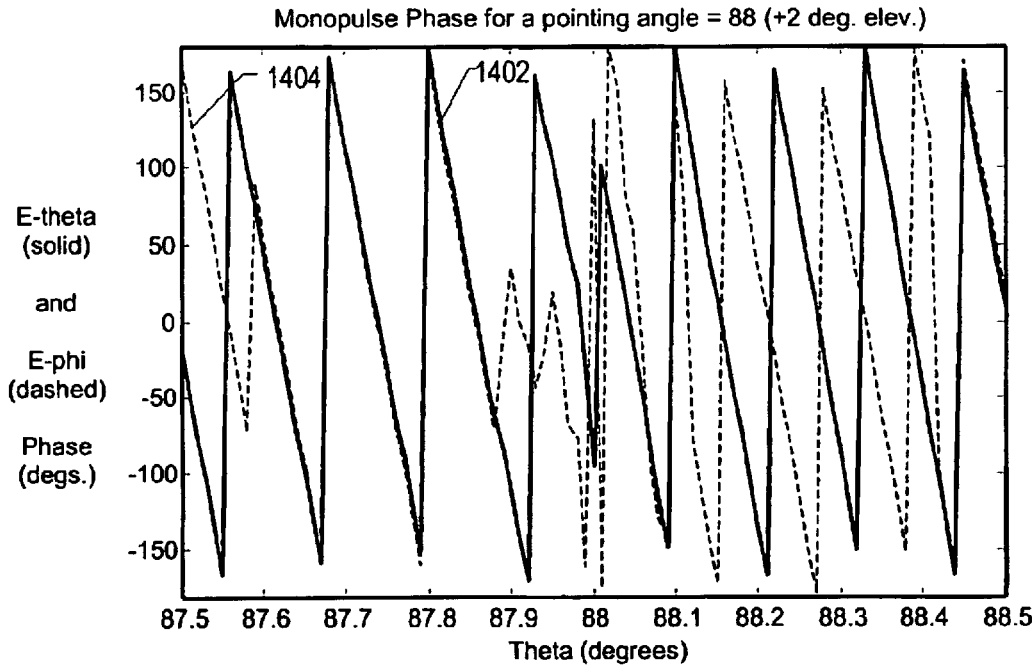

FIGS. 14*a* and 14*b* illustrate additional important properties at 10 GHz concerning cross-polarization and direction of arrival (DOA) determination for various embodiments. FIG. 14*a* shows over a larger range of angles (±0.5 degrees), that the cross polarized component term, 1404, is approximately 10 dB below the primary, 1402, thereby precluding the possibility that it would fill in the null of the primary polarization and inhibit direction finding. For purposes of clarifying further discussion, the angular resolution from these theoretical simulations is estimated to be approximately one hundredth of a degree, or $\Delta\phi$~0.01 degrees, as depicted 1406 in FIG. 14*a*. FIG. 14*b* plots the phase of the primary and cross-polarized components. The phase for the primary polarization (line 1402 shown solid) remained predictably monotonic on both sides of the 88-degree boresight value, indicating that DOA information may be readily extracted from a combination of the magnitude and phase patterns of the primary polarized component.

Referring back to FIG. 2, in an embodiment, only momentary alignment with the target may be needed. As the target weaves in and out of the laser's angular range of lethality, the triggering mechanism may assess a point at which the laser axis will be aligned to the target. In some embodiments, to accomplish this, laser weapon cartridge 200 may use a closed loop triggering method. In various embodiments, a closed loop triggering method may achieve suitable gun/target alignment for firing the weapon. In an embodiment, a closed loop triggering method may be performed by processor 220. In some embodiments, RF energy may be received by an antenna array, 224, situated at the front of laser weapon cartridge 200 (e.g., via passive or bi-static acquisition). In some embodiments, the RF signal received will be favorably influenced by the presence of the gun barrel, as shown above in FIGS. 13*a*, 13*b*, and FIGS. 14*a* and 14*b*. In some embodiments, processor 220 may analyze RF energy received by the antenna array (e.g., to assess DOA information). For example, processor 220 may analyze the phase front, as illustrated in FIG. 14*b*, to assess relative DOA error with respect to gun bore sight. In some embodiments, the relative DOA may be tracked as a function of time. In certain embodiments, tracking the DOA as a function of time may allow an estimate of the coincidence of the RF and optical axes to be made. In some embodiments, once processor 220 assesses that the RF DOA and the optical incidence of the gun containing laser weapon cartridge 200 are aligned, processor 220 may initiate a trigger method. In some embodiments, the triggering method may initiate firing of the laser. In certain embodiments, the trigger method may take into account lasing time and/or the speed of light in determining when to fire the laser.

Figure 15A:
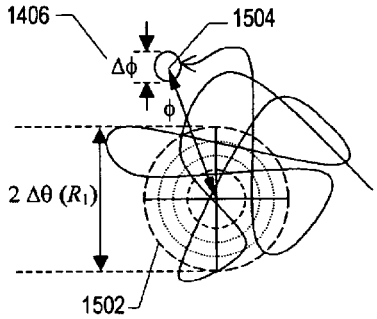
FIG. 15 depicts a ring of lethality of a laser weapon cartridge according to an embodiment.
Figure 15B:
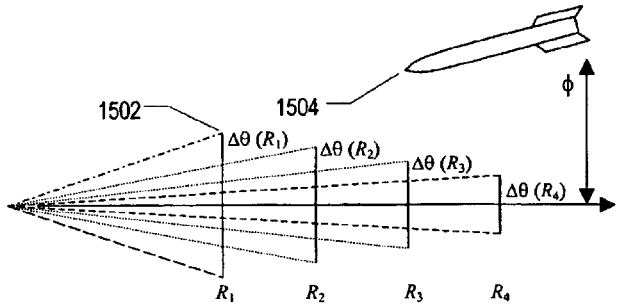

In an embodiment, a triggering method may estimate or predict when a target will be within the laser weapon cartridge's "region of lethality" (e.g., a circular region). The region of lethality may correspond to some angular range off bore sight within which the laser may kill (e.g., a soft kill or hard kill) the target. FIG. 15*a* depicts a cross-sectional view of several circles of lethality, where the circle radius of lethality corresponds to target range, $R_1$, 1502, is shown according to an embodiment. FIG. 15*b* provides a side view of the laser's circles of lethality, which decrease with increasing target range ($\Delta\theta(R_1)>\Delta\theta(R_2)>\Delta\theta(R_3)>\Delta\theta(R_4)$ for $R_4>R_3>R_2>R_1$). In determining the location of the target, some ambiguity may occur. In an embodiment, circle 1504 may represent a location of the target accounting for ambiguity. Circle 1504 may have a diameter, $\Delta\phi$ representing the degree of ambiguity estimated from the received phase front illustrated in FIG. 14*b*. In an embodiment, $\phi$ may be the composite bore-sight angle difference (e.g., including both azimuth, $\xi$, and elevation, $\psi$) between the true target location and the actual pointing direction of the gun. The laser may have a region of lethality 1502 designated by the angle $\Delta\theta$. Since the size of region of lethality 1502 may vary for different ranges of interest, the size of region of lethality 1502 may decrease as a function of range, R. Thus, in some embodiments, the diameter of the region of lethality 1502 may be described as $2\Delta\theta(R)$. In various embodiments, when the processor senses that the target boresight angle $\phi$ will be less than $\Delta\theta$, the lasing action may be triggered.

Figure 16A:
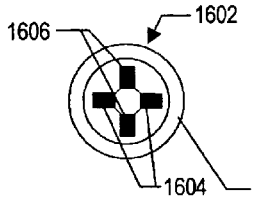
FIGS. 16*a*–16*b* depicts scattering from a four element antenna array disposed in a cylinder, according to an embodiment.
Figure 16B:
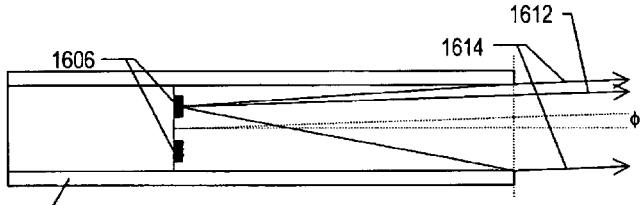

In FIG. 16*a*, an embodiment of an antenna array 1602 may include a minimum of two orthogonal antenna element pairs (i.e., horizontal pair 1604 and vertical pair 1606) within gun 1608, shown from the side in FIG. 16*b*. In an embodiment, diffraction scatter mechanisms for the four antenna elements of antenna array 1602 may be modeled individually to yield estimates of the sum and difference patterns, as shown in FIGS. 14 and 15. In an embodiment, ray components determining mono-pulse directivity are the direct ray 1612 components and the diffracted ray components 1614, for the angular region 1116, bounded by $\pm\epsilon_1$ 1310. In certain embodiments, an antenna may include more than four antenna elements. In an embodiment, antenna array 1602 may include four antenna elements with each element circularly separated by 90° within the gun barrel surrounding the laser optics opening. In some embodiments, antenna array 1602 may be used to estimate target angular direction off of boresight. For example, vertical element pair

Figure 17A:
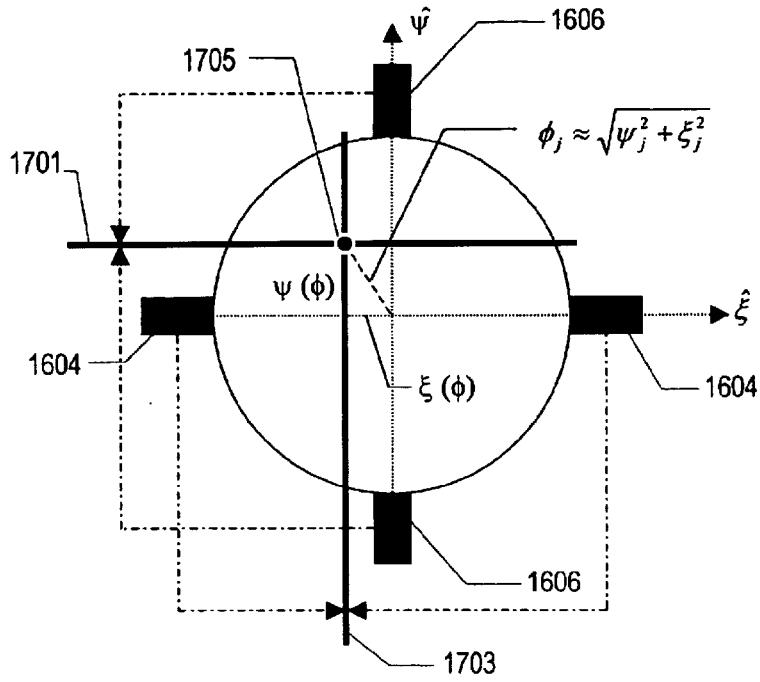
FIGS. 17*a–b* depict a direction of arrival (DOA) determination for a four-element (2-pair) array and an eight-element (4-pair) array, according to an embodiment.

1606 may be used to provide elevation angle boresight differences 1701 (see FIG. 17). Similarly, horizontal element pair 1604 may be used to provide azimuth boresight differences 1703. Together vertical element pair 1606 and horizontal element pair 1604 may be used in some embodiments to form an azimuth-elevation relative boresight difference estimate 1705, as depicted in FIG. 17*a*. In FIGS. 17*a* and *b*, $\psi$ represents the elevation difference component and $\xi$ depicts azimuth difference component. Both angular components may be mathematically related to the total bore sight difference, $\phi$, hence the $\psi(\phi)$ and $\xi(\phi)$ designations.

Figure 17B:
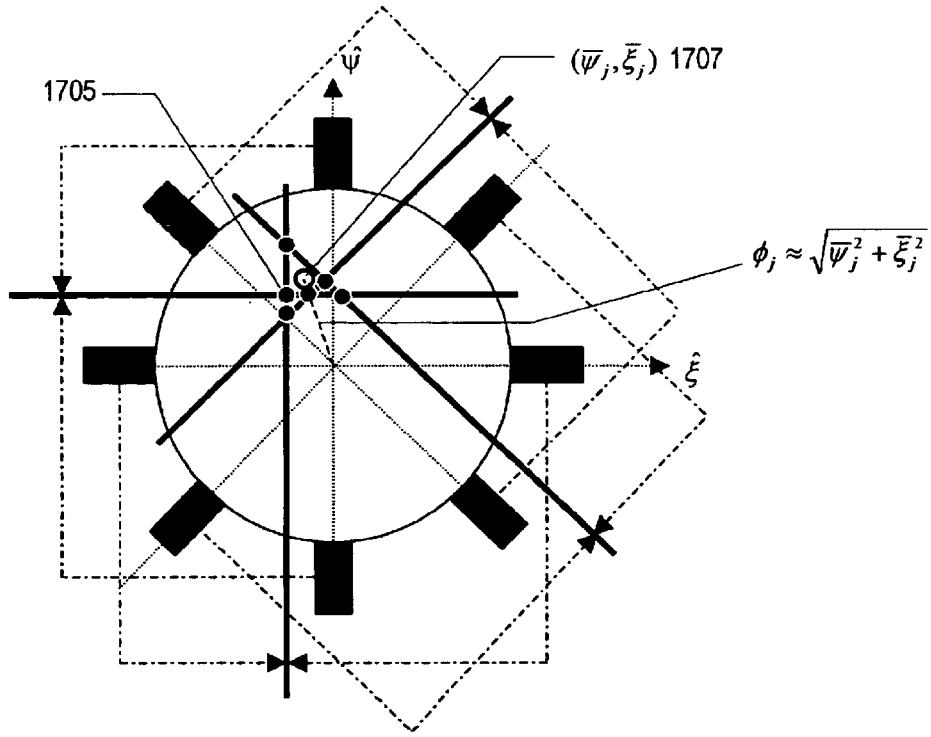

FIGS. 16–17 depict embodiments of the minimum situation where two antenna pairs result in two DOA determinants [$\psi(\phi)$ and $\xi(\phi)$], which result in one intersection, and therefore, one target location estimate 1705, at that point in time. In various embodiments, more element pairs may be used as part of the annular antenna. For instance, with 4, 6, 8 and 16 element pairs, the number of angular target location intersections may rise to 6, 15, 28 and 120, respectively. FIG. 17*b* illustrates the case with four element pairs, resulting in 6 intersections. Thus in various embodiments with more element pairs, the algorithm may estimate target location as a probability distribution computed from the intersections of FIG. 17*b*, resulting in a mean estimate 1707, differing from the two-element pair estimate 1705. In some embodiments, if all of the intersections are fairly coincident, there may be a high confidence of target position because the variance of the intersection locations and therefore the probability distribution is small. In some embodiments, if they are dispersed, the variance of the probability distribution may be large and the confidence may drop. In some embodiments, the mean or weighted target location extracted from the probabilities may also allow temporal plotting via standard tracking algorithms (e.g. Kalman filtering), which may allow further relative target location smoothing. In some embodiments, access to multi-channel data may enable exploiting the fact that polarization-independent random noise components may be diminished by standard interference cancellation (e.g. Wiener filtering) approaches.

In an embodiment, tracking, engagement, and/or firing routines specific to a weapons platform may be prepared. For example, a tracking, engagement and/or firing routine may be specific to a type of gun, or an operating environment (e.g., sea-based, land-based, air-based or space-based). For ease of reference, tracking, engagement and/or firing routines may be collectively referred to herein as "weapon system routines."

Figure 18:
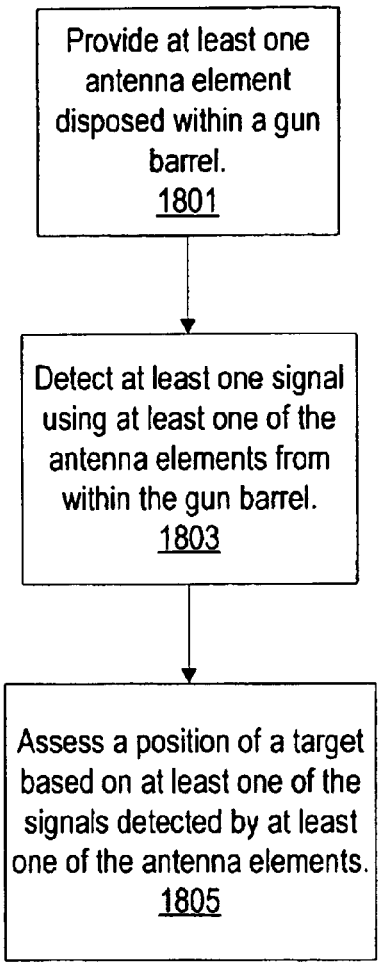
FIG. 18 illustrates a flowchart of a method for firing a laser cartridge, according to an embodiment.

FIG. 18 illustrates a flowchart of a method for firing a weapon, according to an embodiment. At 1801, at least one antenna element may be provided within a gun barrel. At 1803, at least one signal may be detected using at least one of the antenna elements from within the gun barrel. In some embodiments, the signal may be reflected off of the target or may be transmitted by the target. At 1805, a position of a target may be assessed based on the at least one signal detected by at least one of the antenna elements. In some embodiments, the weapon may be fired at the position of the target.

Figure 19:
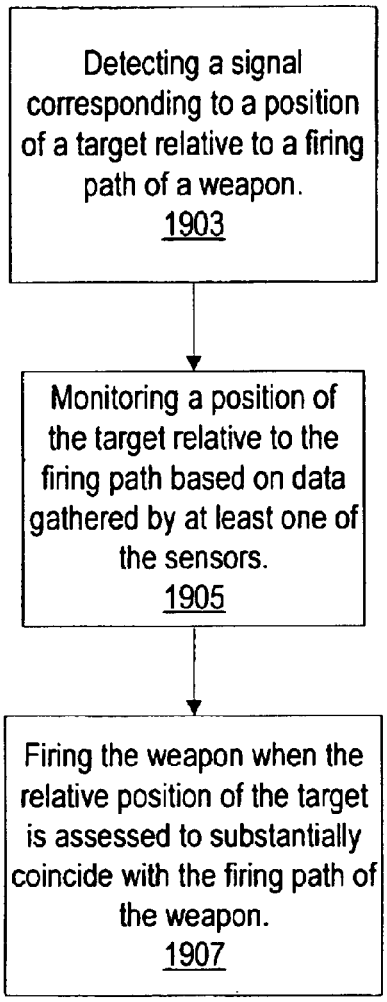
FIG. 19 illustrates a flowchart of a method for firing a weapon upon monitoring the position of a target, according to an embodiment.

FIG. 19 illustrates a flowchart of a method for firing a weapon upon monitoring the position of a target, according to an embodiment. At 1901, a signal corresponding to a position of a target relative to a firing path of a weapon may be detected with at least one sensor. At 1903, a position of the target relative to the firing path may be monitored based on data gathered by at least one of the sensors. At 1907, the weapon may be fired when the relative position of the target is assessed to substantially coincide with the firing path of the weapon.

Figure 20:
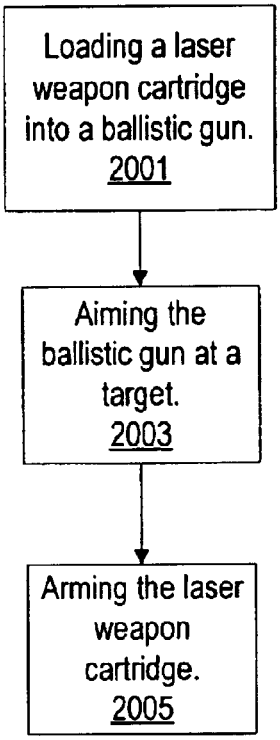
FIG. 20 illustrates a flowchart of a method for using a laser cartridge in conjunction with a gun barrel, according to an embodiment.

FIG. 20 illustrates a flowchart of a method for using a laser cartridge in conjunction with a gun barrel, according to an embodiment. At 2001, a laser weapon cartridge may be loaded into a ballistic gun. At 2003, the ballistic gun may be aimed at the target. At 2005, the laser weapon cartridge may be armed. In some embodiments, arming the laser weapon cartridge may configure the laser weapon cartridge to automatically fire at the target.

Figure 21:
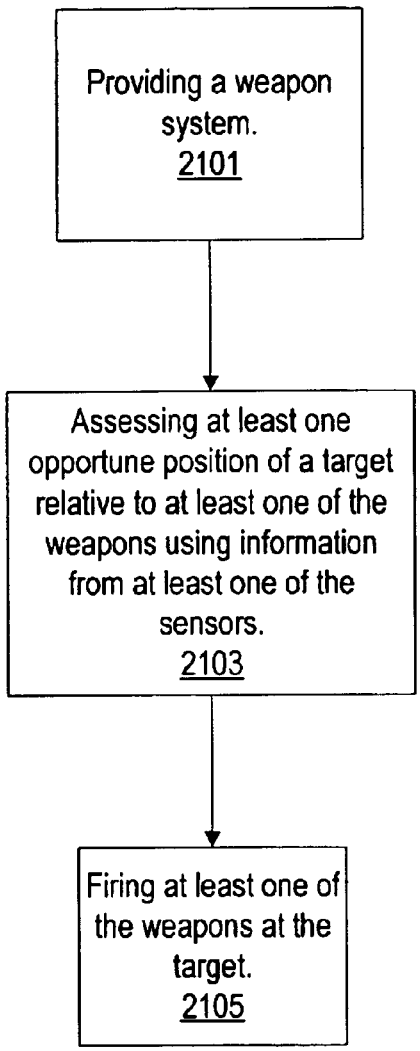
FIG. 21 illustrates a flowchart of a method for determining an opportune position of a target to coordinate firing the weapon, according to an embodiment.

FIG. 21 illustrates a flowchart of a method for determining an opportune position of a target to coordinate firing the weapon, according to an embodiment. At 2101, a weapon system may be provided. At 2103, at least one opportune position of a target may be assessed relative to at least one of the weapons using information from at least one of the sensors. At 2105, at least one of the weapons may be fired at the target if firing the weapon at the target will not inhibit firing at the target again when the target is in the opportune position. In some embodiments, the weapon may be fired multiple times before the target is in an opportune position. Because there may be a time delay between each firing, the weapon may be fired prior to the target being in an opportune position if the following delay will not overlap with the target being in an opportune position.

Figure 22:
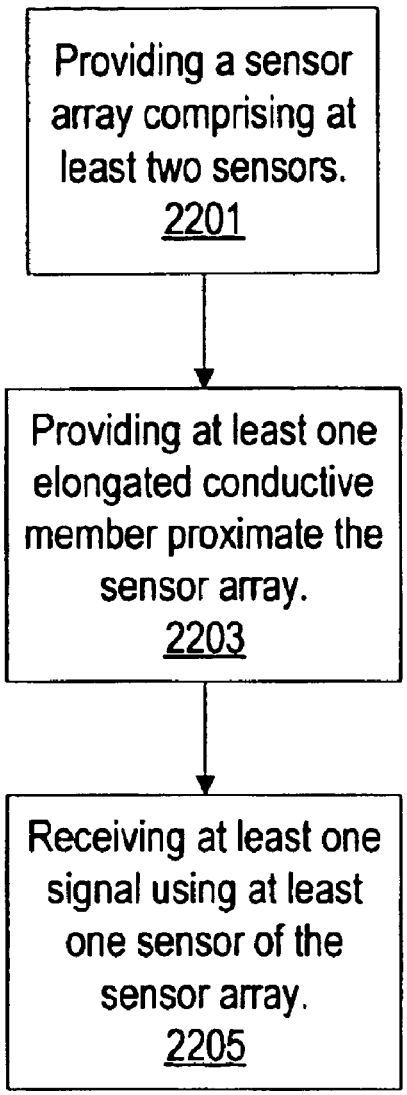
FIG. 22 illustrates a flowchart of a method for inhibiting multipath error, according to an embodiment.

FIG. 22 illustrates a flowchart of a method for inhibiting multipath error, according to an embodiment. At 2201, a sensor array with at least two sensors may be provided. In some embodiments, the sensor array may be configured to detect at least one signal. For example, the signal may be reflected energy from a target or emitted energy from a target. At 2203, at least one elongated conductive member (e.g., a gun barrel) may be provided proximate the sensor array. In some embodiments, the elongated conductive member may be configured to at least partially shield at least one sensor of the sensor array from at least one signal if a direction of arrival of at least one signal is outside an assessed angle relative to the sensor array. For example, energy reflected off of the ocean surface, near a ship with the gun barrel, may be blocked by the gun barrel. At 2205, at least one signal may be received using at least one sensor of the sensor array. For example, energy reflected off of the target, and in line with the gun barrel opening, may be received by the sensor array.

Further modifications and alternative embodiments of various aspects of embodiments described herein may be apparent to those skilled in the art in view of this description. Accordingly, this description is to be construed as illustrative only and is for the purpose of teaching those skilled in the art the general manner of carrying out the invention. Elements and materials may be substituted for those illustrated and described herein, parts and processes may be reversed, and certain features of the invention may be utilized independently, all as would be apparent to one skilled in the art after having the benefit of this description to the invention. Changes may be made in the elements described herein without departing from the spirit and scope of the invention as described in the following claims. In addition, it is to be understood that features described herein independently may, in certain embodiments, be combined.

What is claimed is:

1. A system, comprising:

a gun comprising a gun barrel;

a gun pointing system, wherein the gun pointing system is configured to point the gun toward a target; and a laser weapon disposed within the gun barrel, wherein the laser weapon comprises a laser weapon cartridge and at least one antenna.

2. The system of claim 1, further comprising a loading system coupled to the gun, wherein the laser weapon cartridge is configured to be loaded into the gun barrel via the loading system.

3. The system of claim 1, further comprising a spent shell ejection system, wherein the laser weapon cartridge is configured to be removed from the gun barrel via the spent shell ejection system.

4. The system of claim 1, wherein the gun pointing system is further configured to track the target over a period of time.

5. The system of claim 1, further comprising at least one radar system, wherein at least one of the radar systems is configurable to assess a position of the target.

6. The system of claim 1, further comprising at least one radar system, wherein at least one of the radar systems is configurable to transmit at least one radar signal, and wherein at least one antenna of the laser weapon is configured to detect the at least one radar signal transmitted by the at least one radar system.

7. The system of claim 1, wherein the laser weapon comprises a high-energy laser.

8. The system of claim 7, wherein the laser weapon comprises sufficient reactants to fire the laser at least one time.

9. The system of claim 1, wherein the laser weapon further comprises at least one processor, wherein at least one of the processors is configurable to initiate firing of the laser weapon.

10. The system of claim 1, wherein the laser weapon further comprises at least one processor, wherein at least one of the processors is configurable to assess a relative position of the target based on data gathered by the at least one antenna and to initiate firing of the laser weapon.

11. The system of claim 1, wherein the laser weapon is configured to operatively engage a firing device of the gun to couple with an external component of a fire control system.

12. The system of claim 1, wherein the laser weapon is configured to be armed by a firing device of the gun.

13. The system of claim 1, wherein the laser weapon further comprises at least one processor, wherein at least one of the processors is configurable to estimate at least one target location where the laser weapon has a relatively high probability of damaging the target.

14. The system of claim 1, wherein the laser weapon further comprises at least one processor, wherein at least one of the processors is configurable to estimate at least one target location where the laser has a relatively high probability of damaging the target and wherein at least one of the processors is configurable to inhibit firing the laser weapon when the target is at a location where the laser weapon has a relatively lower probability of damaging the target.

15. The system of claim 1, wherein pointing the gun toward the target comprises pointing the gun such that the at least one antenna has a substantially direct line of sight to the target.

16. The system of claim 1, wherein the laser weapon further comprises at least one processor, wherein at least one of the processors is configurable to assess a relative position of the target based on data gathered by the at least one antenna and to initiate firing of the laser weapon, wherein determining relative position of the target comprises determining at least two potential positions of the target and determining a relative position of the target based on the at least two potential positions.

17. The system of claim 1, wherein the gun barrel shields the at least one antenna from at least a portion of electromagnetic energy proximate the gun barrel.

18. The system of claim 1, wherein the gun barrel shields the at least one antenna from at least a portion of electromagnetic energy traveling along a path that does not correspond to a direct line of sight to the at least one antenna.

19. The system of claim 1, wherein the laser weapon further comprises at least one processor in communication with the at least one antenna, wherein at least one signal received by the at least one antenna is usable by at least one processor to assess a relative position of the target with respect to the optical axis.

20. The system of claim 1, wherein the laser weapon further comprises a programmable processor, wherein the programmable processor is at least configurable to receive program instructions, and wherein the program instructions configure the programmable processor to initiate firing of the laser weapon based on programmed conditions and data received from the at least one antenna.

21. The system of claim 1, wherein the gun barrel comprises rifling.

22. The system of claim 1, wherein the gun barrel is substantially smooth.

23. The system of claim 1, wherein the gun barrel has a diameter of approximately five inches.

24. A system comprising:

a hollow elongated member;

at least one sensor which may be disposed within the hollow elongated member, wherein at least one of the sensors is configured to gather data corresponding to a position of a target; and a laser weapon cartridge disposed within the hollow elongated member and in communication with at least one of the sensors; wherein the laser weapon cartridge is configured to fire automatically in response to data gathered by at least one of the sensors.

25. The system of claim 24, wherein an inner surface of the hollow elongated member is substantially smooth.

26. The system of claim 24, wherein an inner surface of the hollow elongated member comprises a plurality of projections.

27. The system of claim 24, wherein the hollow elongated member comprises a substantially circular cross section.

28. The system of claim 24, wherein the hollow elongated member comprises a noncircular cross section.

29. The system of claim 24, further comprising at least one radar system in communication with at least one aiming system, wherein at least one of the radar systems is configured to receive at least one radar signal corresponding to the position of the target and to send the data related to the position of the target to the aiming system; and wherein at least one of the sensors disposed within the hollow elongated member is configured to detect at least one radar signal corresponding to the position of the target to assess when the target is substantially aligned with a firing path of a laser optical axis.

30. The system of claim 24, wherein the laser weapon cartridge comprises a processor, wherein the processor is configured to receive data from at least one of the sensors disposed within the hollow elongated member to assess the position of the target relative to a laser optical axis.

31. The system of claim 24, wherein at least one sensor is configured to detect radar signals corresponding to a position of the target to assess when the target is substantially aligned with a firing path of the laser optical axis.

32. The system of claim 24, wherein the laser weapon cartridge comprises a processor, wherein the processor is configured to receive data from at least one of the sensors to assess the position of the target relative to a laser optical axis.

33. The system of claim 24, wherein the laser weapon cartridge comprises a processor, wherein the processor is configured to receive data from at least one of the sensors to assess the position of the target relative to the laser optical axis, and wherein the processor is further configurable to initiate firing of the laser weapon cartridge if the position of the target is substantially aligned with a firing path of the laser optical axis.

34. The system of claim 24, wherein the laser weapon cartridge comprises a programmable processor, wherein the programmable processor is configured to receive program instructions, and wherein the program instructions configure the programmable processor to initiate firing the laser weapon cartridge based on programmed conditions and data received from at least one of the sensors.

35. The system of claim 24, wherein the laser weapon cartridge comprises a processor, wherein the processor is configured to initiate firing of the laser weapon cartridge based on data received from at least one of the sensors.

36. The system of claim 24, further comprising an aiming system configured to track the target over a period of time.

37. The system of claim 24, wherein the laser weapon cartridge is configured to be removed from the hollow elongated member after firing.

38. The system of claim 24, further comprising at least one processor, wherein at least one of the processors performs an arming process to initiate gathering of position data by at least one of the sensors.

39. The system of claim 24, further comprising at least one processor, wherein at least one of the processors performs an arming process to initiate the laser weapon cartridge to begin searching for an opportunity to automatically fire.

40. The system of claim 24, wherein the laser weapon cartridge comprises a high-energy laser.

41. The system of claim 24, wherein the laser weapon cartridge comprises at least one processor, wherein at least one of the processors is configured to assess at least one target location where a laser beam has a relatively high probability of damaging the target.

42. The system of claim 24, wherein the laser weapon cartridge comprises at least one processor, wherein at least one of the processors is configured to assess one or more target locations where a laser beam has a relatively high probability of damaging the target, and wherein at least one of the processors is further configured to inhibit firing of the laser weapon cartridge when the target is at a location where a laser beam has a relatively lower probability of damaging the target.

43. The system of claim 24, further comprising an arming system, wherein the arming system aims the hollow elongated member in a desired direction comprises aiming the hollow elongated member toward the target such that at least one sensor has a substantially direct line of sight to the target.

44. The system of claim 24, wherein the hollow elongated member is configured to shield at least one of the sensors from at least a portion of electromagnetic energy proximate the hollow elongated member.

45. The system of claim 24, further comprising at least one processor in communication with at least one of the sensors, wherein signals received by at least one of the sensors are usable by at least one of the processors to assess relative position of the target with respect to an optical axis.

46. The system of claim 24, further comprising at least one processor in communication with at least one of the sensors, wherein at least one signal received by at least one of the sensors is usable by at least one of the processors to assess relative direction of the target.

* * * * *